US008335584B2

(12) United States Patent
Yamada

(10) Patent No.: US 8,335,584 B2
(45) Date of Patent: Dec. 18, 2012

(54) EMBROIDERY DATA GENERATING APPARATUS AND COMPUTER-READABLE MEDIUM STORING EMBROIDERY DATA GENERATING PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 454 days.

(21) Appl. No.: 12/662,960

(22) Filed: May 13, 2010

(65) Prior Publication Data

US 2010/0305744 A1 Dec. 2, 2010

(30) Foreign Application Priority Data

May 28, 2009 (JP) ..... 2009-129105

(51) Int. Cl.
*D05C 5/02* (2006.01)

(52) U.S. Cl. ..... 700/138; 112/470.01

(58) Field of Classification Search ..... 700/136–138; 112/102.5, 453, 470.01, 470.06, 475.18, 112/475.19
See application file for complete search history.

(56) References Cited

U.S. PATENT DOCUMENTS

| | | | | |
|---|---|---|---|---|
| 5,701,830 | A * | 12/1997 | Muto | 112/102.5 |
| 5,765,496 | A * | 6/1998 | Futamura | 112/475.19 |
| 5,794,553 | A * | 8/1998 | Futamura | 112/102.5 |
| 5,839,380 | A * | 11/1998 | Muto | 112/102.5 |
| 6,324,441 | B1 | 11/2001 | Yamada | |
| 6,629,015 | B2 | 9/2003 | Yamada | |
| RE38,718 | E * | 3/2005 | Futamura | 700/138 |
| 7,680,558 | B2 | 3/2010 | Yamada | |
| 7,991,500 | B2 * | 8/2011 | Roos | 700/138 |
| 2002/0038162 | A1 * | 3/2002 | Yamada | 700/138 |
| 2007/0162177 | A1 * | 7/2007 | Yamada | 700/138 |
| 2007/0233309 | A1 * | 10/2007 | Yamada | 700/138 |

FOREIGN PATENT DOCUMENTS

| | | |
|---|---|---|
| JP | A-7-100277 | 4/1995 |
| JP | A-11-169568 | 6/1999 |
| JP | A-2000-288275 | 10/2000 |
| JP | A-2001-259268 | 9/2001 |
| JP | A-2007-175087 | 7/2007 |

OTHER PUBLICATIONS

Japanese Office Action issued in Japanese Patent Application No. 2009-129105 dated Apr. 19, 2011 (with translation).

* cited by examiner

*Primary Examiner* — Nathan Durham
(74) *Attorney, Agent, or Firm* — Oliff & Berridge, PLC

(57) ABSTRACT

An embroidery data generating apparatus includes a thread color acquisition device that acquires available thread colors for an embroidery pattern, a line segment data generating device that generates line segment data, a dividing device that divides a whole area of an image into divided areas, a determining device that determines a representative color for each of the divided areas, an area thread color allocating device that allocates to the divided area at least one area thread color satisfying a predetermined condition, an associating device that associates the line segment data and the divided area, an embroidery thread color allocating device that allocates, from among the at least one area thread color, an embroidery thread color to each piece of the line segment data, a connecting line segment data generating device that generates connecting line segment data, and an embroidery data generating device that generates embroidery data.

14 Claims, 18 Drawing Sheets

FIG. 6

| No | R | G | B |
|---|---|---|---|
| 1 | 255 | 255 | 255 |
| 2 | 182 | 157 | 169 |
| 3 | 240 | 170 | 200 |
| 4 | 160 | 220 | 240 |
| 5 | 210 | 170 | 100 |
| 6 | 175 | 116 | 34 |
| 7 | 190 | 65 | 85 |
| 8 | 120 | 100 | 10 |
| 9 | 81 | 81 | 81 |
| 10 | 50 | 25 | 5 |

FIG. 7

| No | R | G | B |
|---|---|---|---|
| 1 | 240 | 240 | 240 |
| 2 | 168 | 168 | 168 |
| 3 | 252 | 187 | 196 |
| 4 | 168 | 222 | 235 |
| 5 | 208 | 166 | 96 |
| 6 | 178 | 118 | 36 |
| 7 | 181 | 76 | 100 |
| 8 | 125 | 111 | 0 |
| 9 | 79 | 85 | 86 |
| 10 | 42 | 19 | 1 |

FIG. 8

| No | R | G | B |
|---|---|---|---|
| 1 | 253 | 251 | 251 |
| 2 | 153 | 196 | 196 |
| 3 | 226 | 174 | 161 |
| 4 | 242 | 144 | 73 |
| 5 | 91 | 131 | 209 |
| 6 | 143 | 90 | 159 |
| 7 | 165 | 103 | 71 |
| 8 | 55 | 79 | 147 |
| 9 | 107 | 26 | 100 |
| 10 | 153 | 36 | 9 |
| 11 | 74 | 27 | 19 |
| 12 | 14 | 31 | 65 |

FIG. 12

| | 1 | 2 | 3 | 4 | 5 | 6 | 7 | 8 | 9 | 10 |
|---|---|---|---|---|---|---|---|---|---|---|
| 1 | 20.273 | 144.92 | 84.392 | 91.225 | 182.41 | 263.7 | 242.1 | 314.62 | 291.65 | 401.05 |
| 2 | 106.96 | 42.344 | 99.408 | 49.214 | 118 | 179.75 | 156.2 | 215.46 | 172.91 | 285.79 |
| 3 | 103.89 | 58.728 | 45.497 | 105.57 | 67.919 | 145.14 | 123.9 | 200.23 | 187.5 | 288.93 |
| 4 | 192.64 | 122.79 | 130.68 | 194.43 | 46.573 | 78.365 | 95.258 | 141.8 | 173.84 | 246.59 |
| 5 | 187.2 | 94.758 | 170.96 | 122.01 | 166.38 | 194.08 | 151.68 | 212.69 | 131.87 | 241.27 |
| 6 | 196.14 | 82.401 | 150.53 | 154.35 | 118.19 | 130.91 | 71.561 | 161.39 | 97.211 | 200.51 |
| 7 | 230.12 | 116.8 | 173.93 | 202.65 | 80.268 | 40.237 | 42.732 | 81.884 | 89.135 | 164.58 |
| 8 | 262.29 | 145.37 | 229.94 | 202.39 | 183.25 | 170.21 | 134.51 | 165.93 | 65.826 | 158.38 |
| 9 | 288.24 | 168.85 | 236.99 | 245.69 | 172.68 | 132.67 | 89.308 | 132.47 | 66.791 | 118.64 |
| 10 | 320.23 | 207.2 | 259.94 | 293.08 | 165.81 | 89.878 | 103.27 | 80.561 | 117.5 | 112.58 |
| 11 | 348.95 | 225.65 | 297.68 | 305.81 | 207.86 | 139.23 | 142.87 | 100.09 | 88.758 | 37.577 |
| 12 | 354.09 | 230.42 | 313.27 | 298.49 | 238.37 | 187.9 | 176.46 | 151.48 | 87.075 | 70.88 |

FIG. 15

| | 1 | 2 | 3 | 4 | 5 | 6 | 7 | 8 | 9 | 10 |
|---|---|---|---|---|---|---|---|---|---|---|
| 1 | 20.273 | 144.92 | 84.392 | 91.225 | 182.41 | 263.7 | 242.1 | 314.62 | 291.65 | 401.05 |
| 2 | 106.96 | 42.344 | 99.408 | 49.214 | 118 | 179.75 | 156.2 | 215.46 | 172.91 | 285.79 |
| 3 | 103.89 | 58.728 | 45.497 | 105.57 | 67.919 | 145.14 | 123.9 | 200.23 | 187.5 | 288.93 |
| 4 | 192.64 | 122.79 | 130.68 | 194.43 | 46.573 | 78.365 | 95.258 | 141.8 | 173.84 | 246.59 |
| 5 | 187.2 | 94.758 | 170.96 | 122.01 | 166.38 | 194.08 | 151.68 | 212.69 | 131.87 | 241.27 |
| 6 | 196.14 | 82.401 | 150.53 | 154.35 | 118.19 | 130.91 | 71.561 | 161.39 | 97.211 | 200.51 |
| 7 | 230.12 | 116.8 | 173.93 | 202.65 | 80.268 | 40.237 | 42.732 | 81.884 | 89.135 | 164.58 |
| 8 | 262.29 | 145.37 | 229.94 | 202.39 | 183.25 | 170.21 | 134.51 | 165.93 | 65.826 | 158.38 |
| 9 | 288.24 | 168.85 | 236.99 | 245.69 | 172.68 | 132.67 | 89.308 | 132.47 | 66.791 | 118.64 |
| 10 | 320.23 | 207.2 | 259.94 | 293.08 | 165.81 | 89.878 | 103.27 | 80.561 | 117.5 | 112.58 |
| 11 | 348.95 | 225.65 | 297.68 | 305.81 | 207.86 | 139.23 | 142.87 | 100.09 | 88.758 | 37.577 |
| 12 | 354.09 | 230.42 | 313.27 | 298.49 | 238.37 | 187.9 | 176.46 | 151.48 | 87.075 | 70.88 |

EMBROIDERY DATA GENERATING APPARATUS AND COMPUTER-READABLE MEDIUM STORING EMBROIDERY DATA GENERATING PROGRAM

CROSS REFERENCE TO RELATED APPLICATION

This application claims priority to Japanese Patent Application No. 2009-129105, filed May 28, 2009, the content of which is hereby incorporated herein by reference in its entirety.

BACKGROUND

The present disclosure relates to an embroidery data generating device and a computer-readable medium that stores an embroidery data generating program that generate embroidery data to sew an embroidery pattern using an embroidery sewing machine.

An embroidery data generating apparatus is known that acquires image data from an image such as a photo or an illustration etc. and generates embroidery data to be used to sew an embroidery pattern based on the image data. In the embroidery data generating apparatus, the embroidery data is generated using the following procedure. First, based on the image data, line segment data pieces are generated that indicate shapes and relative positions of stitches. Then, thread color data is allocated to each of the line segment data pieces. The thread color data indicates a color of each of the stitches. Next, if a same thread color is allocated to a plurality of line segment data pieces representing a plurality of line segments, connecting line segment data is generated that indicates at least one connecting line segment that connects the plurality of line segments. If stitches formed on the connecting line segment are to be covered by other stitches that are sewn later, needle drop point data is generated that causes a running stitch to be stitched on the connecting line segment. Then, the embroidery data is generated that indicates a sewing order, the thread color, the needle drop points and a stitch type.

In order to accurately express the image by the embroidery pattern, it is preferable for sewing to be performed using threads of colors that are included in the image data. However, the colors of commercially available threads are limited, and it may not possible to prepare threads of all the colors included in the image data. Taking into account a burden on a user to prepare the threads, and time and effort to replace thread at the time of sewing, it is preferable for a small number of thread colors to be used in the sewing. Therefore, the embroidery data generating apparatus represents the colors of the image with a small number of thread colors by color mixing sewing with a plurality of threads with different colors when sewing a specific area. For example, by forming red stitches and yellow stitches in the specific area, the specific area as a whole represents orange.

SUMMARY

In the known embroidery data generating apparatus, of the thread colors to be used for sewing, a color that is closest to the color of the image is selected as the thread color to be used in the above-described color mixing sewing. As a result, for example, an unnatural color that is far from the color of the image may be selected as the thread color to represent the image, such as pale blue being allocated as a color to represent a person's skin color and so on.

Various exemplary embodiments of the broad principles derived herein provide an embroidery data generating apparatus and a computer-readable medium that stores an embroidery data generating program that generate embroidery data to form an embroidery pattern that more accurately represents colors of an image.

Exemplary embodiments provide an embroidery data generating apparatus that includes a thread color acquisition device, a line segment data generating device, a dividing device, a determining device, an area thread color allocating device, an associating device, an embroidery thread color allocating device, a connecting line segment data generating device, and an embroidery data generating device. The thread color acquisition device acquires, as a plurality of available thread colors, colors of threads to be used in sewing an embroidery pattern. The line segment data generating device generates line segment data, each piece of the line segment data representing a position of a line segment that corresponds to a target pixel, the target pixel being at least one of pixels represented by pixel data included in image data. The dividing device, based on the pixel data, divides a whole area of an image represented by the image data into a plurality of divided areas. The determining device, based on the pixel data corresponding to pixels within each of the divided areas, determines a representative color for each of the divided areas generated by the dividing device. The area thread color allocating device compares the representative color for each of the divided areas determined by the determining device with the available thread colors acquired by the thread color acquisition device, and allocates to each of the divided areas at least one of the available thread colors that satisfies a predetermined condition, as at least one area thread color. The associating device, based on a position, in the image, of the target pixel corresponding to each piece of the line segment data, generates an associated relationship between each piece of the line segment data generated by the line segment data generating device and one of the divided areas generated by the dividing device. The embroidery thread color allocating device, based on the associated relationship generated by the associating device and an allocation result obtained by the area thread color allocating device, allocates to each piece of the line segment data one of the at least one area thread color that represents the color of the target pixel corresponding to each of the line segment data, as an embroidery thread color. The connecting line segment data generating device, when a same thread color is allocated as the embroidery thread color to plural pieces of the line segment data by the embroidery thread color allocating device, generates connecting line segment data, each piece of the connecting line segment data representing a connecting line segment to connect two line segments respectively represented by two of the plural pieces of line segment data. The embroidery data generating device generates embroidery data including a sewing order, thread color data and needle drop point data, based on the line segment data generated by the line segment data generating device, the embroidery thread color allocated to each piece of the line segment data by the color allocating device and the connecting line segment data generated by the connecting line segment data generating device.

Exemplary embodiments provide a computer-readable medium storing an embroidery data generating program. The program includes instructions that cause a controller to perform the steps of acquiring, as a plurality of available thread colors, colors of threads to be used in sewing an embroidery pattern, generating line segment data, each piece of the line segment data representing a position of a line segment that corresponds to a target pixel, the target pixel being at least one of pixels represented by pixel data included in image data, dividing, based on the pixel data, a whole area of an image represented by the image data into a plurality of divided areas, and determining, based on the pixel data corresponding to pixels within each of the divided areas, a representative color for each of the divided areas. The program further includes instructions that cause a controller to perform the steps of comparing the representative color for each of the divided areas determined with the acquired available thread colors, and allocating to each of the divided areas at least one of the available thread colors that satisfies a predetermined condition, as at least one area thread color, generating, based on a position, in the image, of the target pixel corresponding to each piece of the line segment data, an associated relationship between each piece of the line segment data and one of the divided areas, allocating, based on the associated relationship and an allocation result, to each piece of the line segment data one of the at least one area thread color that represents the color of the target pixel corresponding to each of the line segment data, as an embroidery thread color, generating, when a same thread color is allocated as the embroidery thread color to plural pieces of the line segment data, connecting line segment data, each piece of the connecting line segment data representing a connecting line segment to connect two line segments respectively represented by two of plural pieces of line segment data, and generating embroidery data that includes a sewing order, thread color data and needle drop point data, based on the line segment data, the embroidery thread color allocated to each piece of the line segment data and the connecting line segment data.

BRIEF DESCRIPTION OF THE DRAWINGS

Exemplary embodiments will be described below in detail with reference to the accompanying drawings in which:

FIG. 6 is a table that shows an example of ten colors (RGB values) obtained when colors of the image in FIG. 5 are reduced;

FIG. 7 is a table that shows an example of available thread colors (RGB values);

FIG. 8 is a table that shows an example of m colors (m is the number of colors) and representative colors (RGB values);

FIG. 12 is an explanatory diagram that illustrates processing that determines at least one area thread color based on color differences between available thread colors and representative thread colors;

FIG. 15 is an explanatory diagram that illustrates processing that determines at least one area thread color based on color differences between available thread colors and representative thread colors;

DETAILED DESCRIPTION

Hereinafter, first to third embodiments of the present disclosure will be explained with reference to the drawings. The drawings are used to explain technological features that the present disclosure can utilize, and a configuration of a device that is described, flowcharts of various types of processing, and the like do not limit the present disclosure to only that configuration, that processing, and the like, but are merely explanatory examples.

Figure 1:
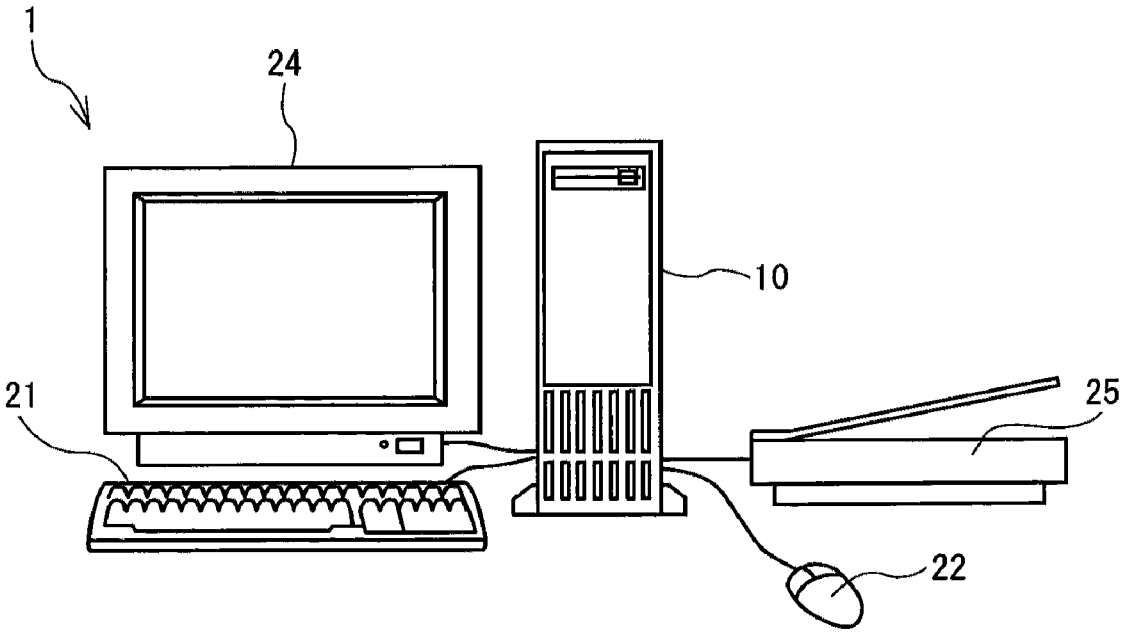
FIG. 1 is an overall configuration diagram that shows a physical configuration of an embroidery data generating apparatus.
Figure 2:
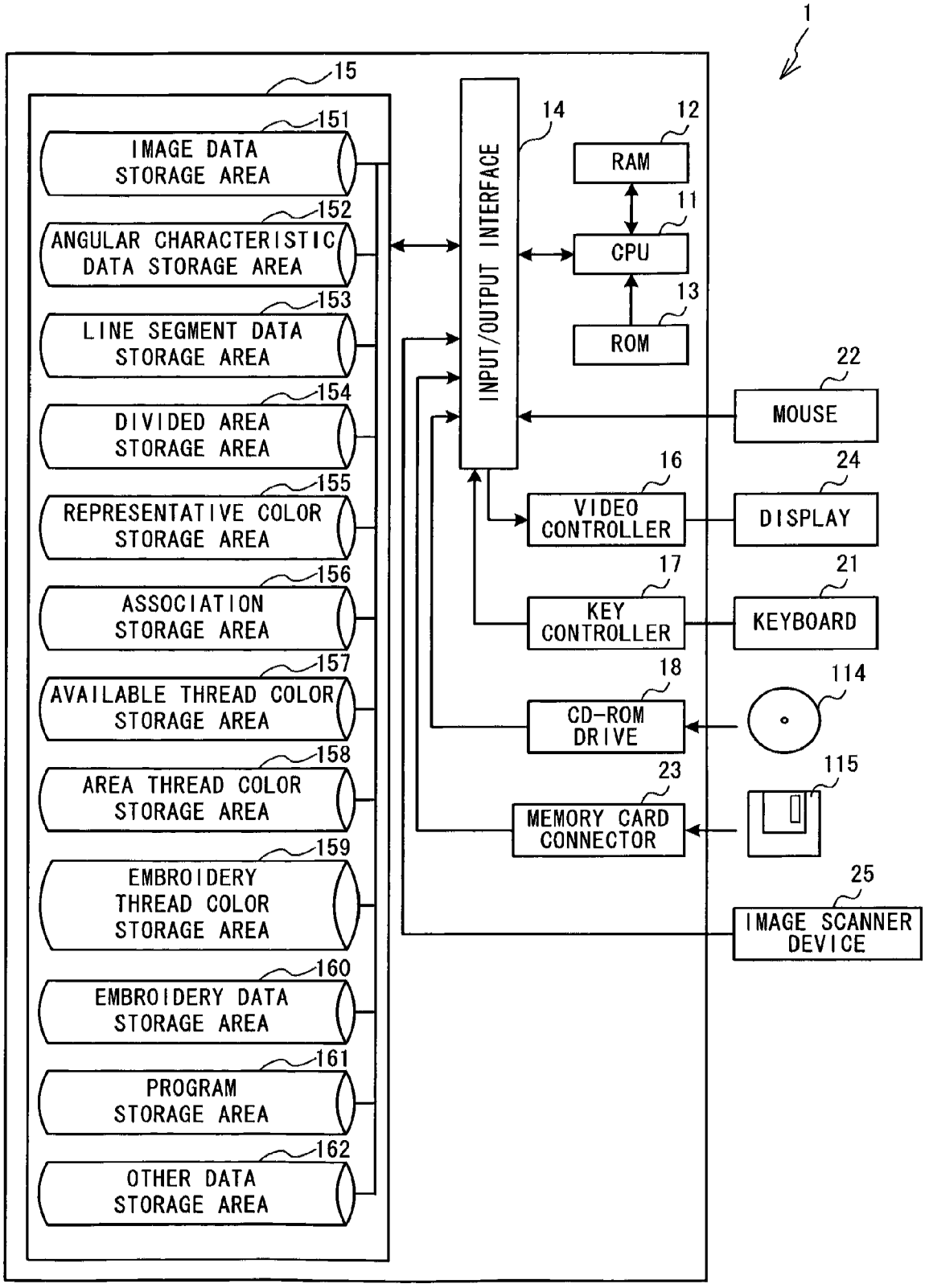
FIG. 2 is a block diagram that shows an electrical configuration of the embroidery data generating apparatus.

First, a common configuration of an embroidery data generating apparatus 1 according to the first to third embodiments will be explained with reference to FIGS. 1 and 2. The embroidery data generating apparatus 1 is a device that generates data for an embroidery pattern that will be sewn by an embroidery sewing machine 3 that will be described later (refer to FIG. 3). In particular, the embroidery data generating apparatus 1 can generate embroidery data to be used to sew an embroidery pattern that will represent an image based on image data acquired from the image, such as a photo or an illustration etc. As shown in FIG. 1, the embroidery data generating apparatus 1 may be, for example, a general-purpose device such as a personal computer or the like. The embroidery data generating apparatus 1 is provided with a main device body 10. The embroidery data generating apparatus 1 is further provided with a keyboard 21, a mouse 22, a display 24, and an image scanner 25 that are connected to the main device body 10. The keyboard 21 and the mouse 22 are each input devices. The display 24 displays information.

Next, an electrical configuration of the embroidery data generating apparatus 1 will be explained with reference to FIG. 2. As shown in FIG. 2, the embroidery data generating apparatus 1 is provided with a CPU 11 that is a controller that performs control of the embroidery data generating apparatus 1. A RAM 12, a ROM 13, and an input/output (I/O) interface 14 are connected to the CPU 11. The RAM 12 temporarily stores various types of data. The ROM 13 stores a BIOS and the like. The input/output interface 14 mediates exchanges of data. A hard disk drive (HDD) 15, the mouse 22, a video controller 16, a key controller 17, a CD-ROM drive 18, a memory card connector 23, and the image scanner 25 are connected to the I/O interface 14. The embroidery data generating apparatus 1 may also be provided with an external interface for connecting to an external device and a network, although this is not shown in FIG. 2.

The HDD 15 has a plurality of storage areas that include an embroidery data storage area 160 and a program storage area 161. Embroidery data that is stored in the embroidery data storage area 160. The embroidery data is generated by the CPU 11 when an embroidery data generating program is executed. The embroidery data are data that will be used when the embroidery sewing machine 3 performs embroidering. The embroidery data includes a sewing order, needle drop point data and thread color data. A plurality of programs that include the embroidery data generating program that are to be executed by the CPU 11 are stored in the program storage area 161. In a case where the embroidery data generating apparatus 1 is a dedicated device that is not provided with the hard disk drive 15, the embroidery data generating program may be stored in the ROM 13.

In addition to the storage areas that are described above, various types of storage areas are included in the HDD 15, in which is stored data that is acquired in a process of executing main processing in accordance with an embroidery data generating program. More specifically, the HDD 15 includes an image data storage area 151, an angular characteristic data storage area 152, a line segment data storage area 153 and a divided area storage area 154. The HDD 15 further includes a representative color storage area 155, an association storage area 156, an available thread color storage area 157, an area thread color storage area 158 and an embroidery thread color storage area 159. Additionally, the HDD 15 includes an other data storage area 162 in which is stored other data used by the embroidery data generating apparatus 1. Initial values and setting values etc. for various parameters, for example, are stored in the other data storage area 162.

The display 24 is connected to the video controller 16, and the keyboard 21 is connected to the key controller 17. A CD-ROM 114 can be inserted into the CD-ROM drive 18. For example, when the embroidery data generating program is installed, the CD-ROM 114, in which is stored the embroidery data generating program that is a control program of the embroidery data generating apparatus 1, is inserted into the CD-ROM drive 18. The embroidery data generating program is then set up and is stored in the program storage area 161 of the HDD 15. A memory card 115 can be connected to the memory card connector 23, and information can be read from the memory card 115 and written to the memory card 115.

Next, the embroidery sewing machine 3 that sews the embroidery pattern based on the embroidery data generated by the embroidery data generating apparatus 1 will be briefly explained with reference to FIG. 3.

Figure 3:
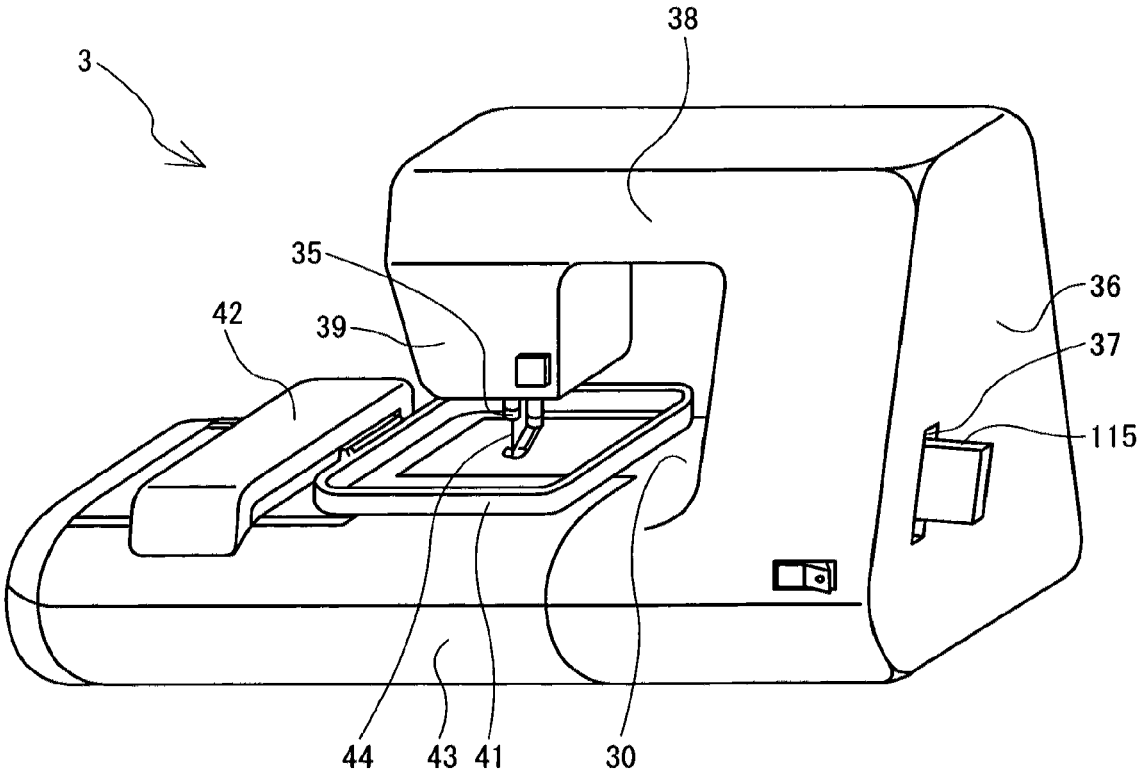
FIG. 3 is an external view of an embroidery sewing machine.

As shown in FIG. 3, the embroidery sewing machine 3 has a sewing machine bed 30, a pillar 36, an arm 38, and a head 39. The long dimension of the sewing machine bed 30 runs left to right in relation to a user. The pillar 36 is provided such that it rises upward from the right end of the sewing machine bed 30. The arm 38 extends to the left from the upper portion of the pillar 36. The head 39 is joined to the left end of the arm 38. An embroidery frame 41 is disposed above the sewing machine bed 30 and holds a work cloth (not shown in the drawings) on which embroidery will be performed. AY direction drive portion 42 and an X direction drive mechanism (not shown in the drawings) that is accommodated within a main body case 43 move the embroidery frame 41 to a specified position that is indicated by an XY coordinate system that is specific to the embroidery sewing machine 3. A needle bar 35 on which a stitching needle 44 is mounted and a shuttle mechanism (not shown in the drawings) are driven in conjunction with the moving of the embroidery frame 41. In this manner, the embroidery pattern is formed on the work cloth. The Y direction drive portion 32, the X direction drive mechanism, and the needle bar 35 and the like are controlled by a control unit (not shown in the drawings) including a microcomputer or the like that is built into the embroidery sewing machine 3

A memory card slot 37 is provided on a side face of the pillar 36 of the embroidery sewing machine 3. The memory card 115 may be inserted into and removed from the memory card slot 37. For example, the embroidery data generated by the embroidery data generating apparatus 1 may be stored in the memory card 115 through the memory card connector 23. The memory card 115 is then inserted into a memory card slot 37, the embroidery data stored in the memory card 115 is read, and the embroidery data is stored in the embroidery sewing machine 3. A control unit (not shown in the drawings) of the embroidery sewing machine 3 automatically controls embroidery operations of the above-described elements, based on the embroidery data that are supplied from the memory card 115. This makes it possible to use the embroidery sewing machine 3 to sew the embroidery pattern based on the embroidery data that are generated by the embroidery data generating apparatus 1.

Figure 4:
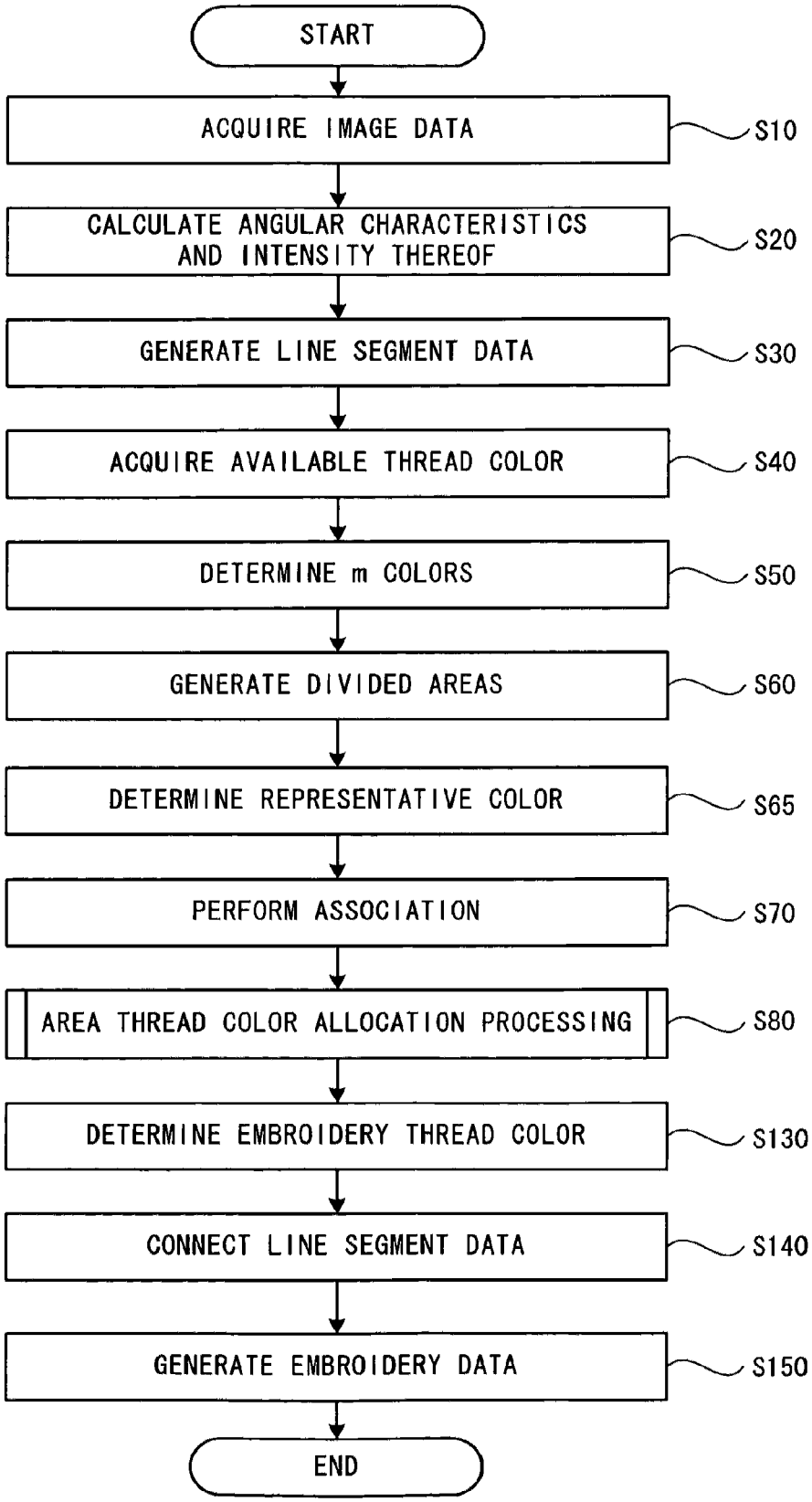
FIG. 4 is a flowchart of main processing.

Next, a processing procedure in which the embroidery data generating apparatus 1 according to the first embodiment generates the embroidery data based on image data will be explained with reference to FIG. 4 to FIG. 13. Main processing including the embroidery data generation, as shown in FIG. 4, is executed by the CPU 11 in accordance with the embroidery data generating program stored in the program storage area 161 of the HDD 15 shown in FIG. 1. For ease of explanation, an explanation will be simplified of processes similar to known technology. For example, Japanese Laid-Open Patent Publication No. 2001-259268 discloses a method that calculates angular characteristic and angular characteristic intensity, the relevant portions of which are herein incorporated by reference. Further, in the present embodiment, various colors are represented by RGB values.

Figure 5:
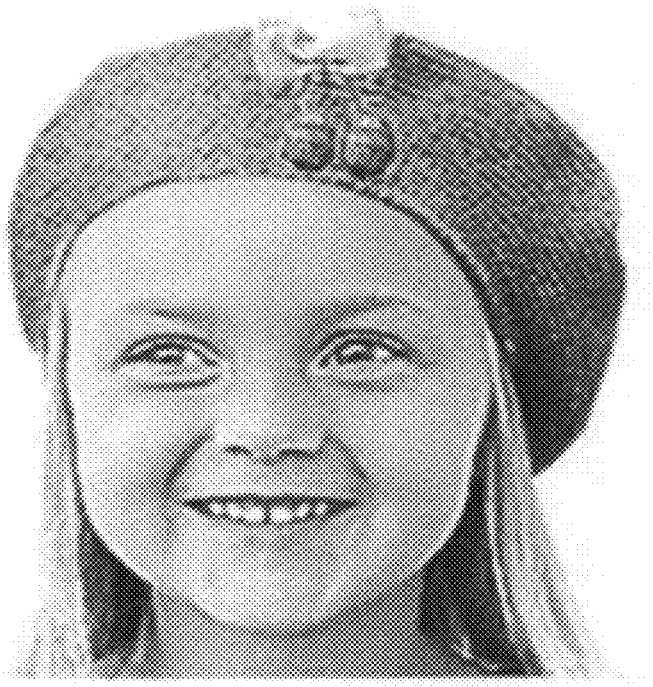
FIG. 5 is an explanatory diagram of an image that is acquired in the main processing.

As shown in FIG. 4, in the main processing of the first embodiment, first, image data is acquired, and the acquired image data is stored in the image data storage area 151 (Step S10). The image data acquired at Step S10 is data representing an image that is to be used to generate the embroidery data. The image data includes pixel data pieces corresponding, respectively, to a plurality of pixels that are arranged on a two dimensional matrix forming the image. The image data may be acquired by any method. For example, the CPU 11 may acquire the image data by scanning the image using the image scanner 25. Alternatively, a file stored on an external storage medium, such as a memory card etc., may be acquired as the image data. At Step S10, for example, the image data representing the photograph shown in FIG. 5 is acquired. FIG. 5 is shown in black and white, but it is a color photograph of a girl with blond hair wearing a blue hat in reality.

Next, the angular characteristic and the angular characteristic intensity of a target pixel of the image represented by the image data acquired at Step S10 (hereinafter simply referred to as the "original image") are calculated, and the calculated angular characteristic and angular characteristic intensity are stored as angular characteristic data in the angular characteristic data storage area 152 (Step S20). The target pixel is a single pixel selected from among the pixels of the original image. A plurality of adjacent pixels may be selected as the target pixels. The angular characteristic indicates a direction of change in brightness of the target pixel. The angular characteristic intensity indicates a magnitude of the change in brightness of the target pixel. Various known methods can be adopted as a method of calculating the angular characteristic and the intensity thereof, and a detailed explanation is therefore omitted here. At Step S20, all the pixels included in the original image are sequentially acquired as the target pixel, and the angular characteristic and the angular characteristic intensity of the acquired target pixel are calculated.

Next, based on the angular characteristic data calculated at Step S20, line segment data is generated such that as much as possible of the whole image can be covered with line segments indicated by the line segment data. The generated line segment data is then stored in the line segment data storage area 153 (Step S30). Each line segment data piece indicates a line segment that is centered on the target pixel, and that has a set angular component and a set length component. More specifically, the angular characteristic data calculated at Step S20 is set as the angular component of the line segment data. Further, a fixed value that is set in advance or a value that is input by a user is set as the length component of the line segment data. Various known methods can be used as a method to generate the line segment data, and a detailed explanation is therefore omitted here.

Next, available thread colors are acquired, and the acquired available thread colors are stored in the available thread color storage area 157 (Step S40). The available thread colors are colors of the threads that are planned to be used when sewing an embroidery pattern using the embroidery sewing machine 3 in accordance with the embroidery data. The embroidery data is generated by the embroidery data generating apparatus 1 based on the image data acquired at Step S10. In the present embodiment, from among thread colors that can be used, n thread colors (n is the number of thread colors) that are selected based on the pixel data are acquired as the available thread colors. The thread colors that can be used are colors of threads that can be prepared by the user as the thread colors to be used in sewing. The thread colors that can be used are represented by fixed values set in advance or by values input by the user. For example, let us assume that thirty colors are set as the thread colors that can be used. At Step S40, first, the colors of the original image are reduced to n colors, n being the number of the available thread colors. A median cut algorithm can be used, for example, as a color reduction method. In this processing, for example, the colors of the original image shown in FIG. 5 are reduced to ten colors indicated by No. 1 to No. 10 in FIG. 6. Next, from among the thirty thread colors that can be used, the thread colors close to each of the colors indicated by No. 1 to No. 10 in FIG. 6 are acquired as the available thread colors. In this processing, for example, the thread colors indicated by No. 1 to No. 10 in FIG. 7 are acquired as the available thread colors. When the available thread colors are determined in this way, appropriate available thread colors can be determined from among the thread colors that can be used, taking into account the number of times to replace threads and the colors of the image. The available thread colors may also be determined as fixed values that are set in advance or as values input by the user.

Next, based on the pixel data, m colors (m is the number of colors) that are colors to be used to divide up the original image are determined, and the determined m colors are stored in the RAM 12 (Step S50). The m colors are determined by color reduction processing of the original image such that the number of colors of the original image is reduced to the number m. The median cut algorithm can be used, for example, as the color reduction method. The m colors will be used in processing that generates divided areas by dividing up the whole area of the original image based on the pixel data. The number of colors m is a fixed value that is set in advance or a value input by the user. In the first embodiment, m corresponds to a number of representative colors of the divided areas. The representative colors will be used in processing that determines at least one area thread color for each divided area. The area thread color is a candidate for a thread color that will be allocated as an embroidery thread color to the line segment data piece corresponding to the target pixel within the divided area. It is thus preferable that the number m be determined while taking into account the number of colors of the original image and the number of the available thread colors. When the number of the representative colors is excessively high in comparison to the number of the available thread colors, there is a smaller possibility of allocating different available thread colors to divided areas corresponding to different representative colors. In other words, there may be a case in which the same available thread color is allocated as the area thread color to a plurality of different divided areas corresponding to the different representative colors. In such a case, while processing to determine the embroidery thread colors becomes complex, commensurate effects may thus not be obtained. On the other hand, when the number of representative colors is excessively low in comparison to the number of available thread colors, there is a smaller possibility that every available thread color is allocated as the area thread color to any one of the divided areas. Thus, it is preferable for the number of representative colors and the number of available thread colors to be approximately the same. In processing at Step S50, for example, color reduction processing is performed on the original image shown in FIG. 5, and twelve colors No. 1 to No. 12 shown in FIG. 8 are determined.

Figure 9:
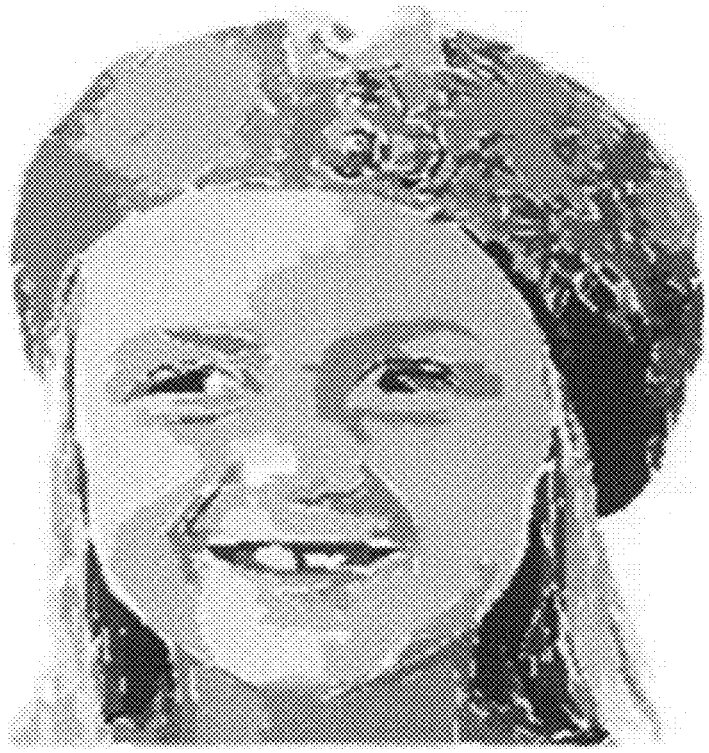
FIG. 9 is an explanatory diagram that illustrates a plurality of divided areas generated by dividing a whole area of the image in FIG. 5.

Then, the whole area of the original image is divided up based on the pixel data, and image data representing the plurality of divided areas generated by the division is stored in the divided area storage area 154 (Step S60). More specifically, by reducing the number of colors of the original image to the number of colors m determined at Step S50 based on the pixel data, the whole area of the original image is divided into the plurality of areas. The color reduction processing is performed, for example, using the median cut algorithm. When a very small area in the whole area of the original image results from the color reduction processing, the very small areas is integrated with another divided area by noise reduction, for example. For ease of explanation, in the first embodiment, areas of the same color obtained as a result of color reduction are assumed to be the same divided area. In the processing at Step S60, for example, the whole area of the original image shown in FIG. 5 is divided up and a plurality of divided areas of the image are generated as shown in FIG. 9.

Next, the representative color is determined for each of the divided areas generated at Step S60, and the determined representative colors are stored in the representative color storage area 155 in association with the corresponding divided areas (Step S65). In the first embodiment, the m colors determined at Step S50 are determined to be the representative colors, without any change. In the processing at Step S65, for example, the twelve colors indicated by No. 1 to No. 12 in FIG. 8 are determined as the representative colors. In the first embodiment, since areas of the same color obtained as a result of color reduction are treated as the same divided area, each of the numbers (No.) in FIG. 8 thus indicates both the number of the representative color and the number of the divided area associated with the representative color. When noise reduction is not performed at Step S60, for example, the generation of the divided areas and the determination of the representative colors may be performed in the processing at Step S50 by performing the color reduction processing such that the number of colors of the original image becomes m, and the processing at Step S60 and Step S65 may be omitted.

Figure 10:
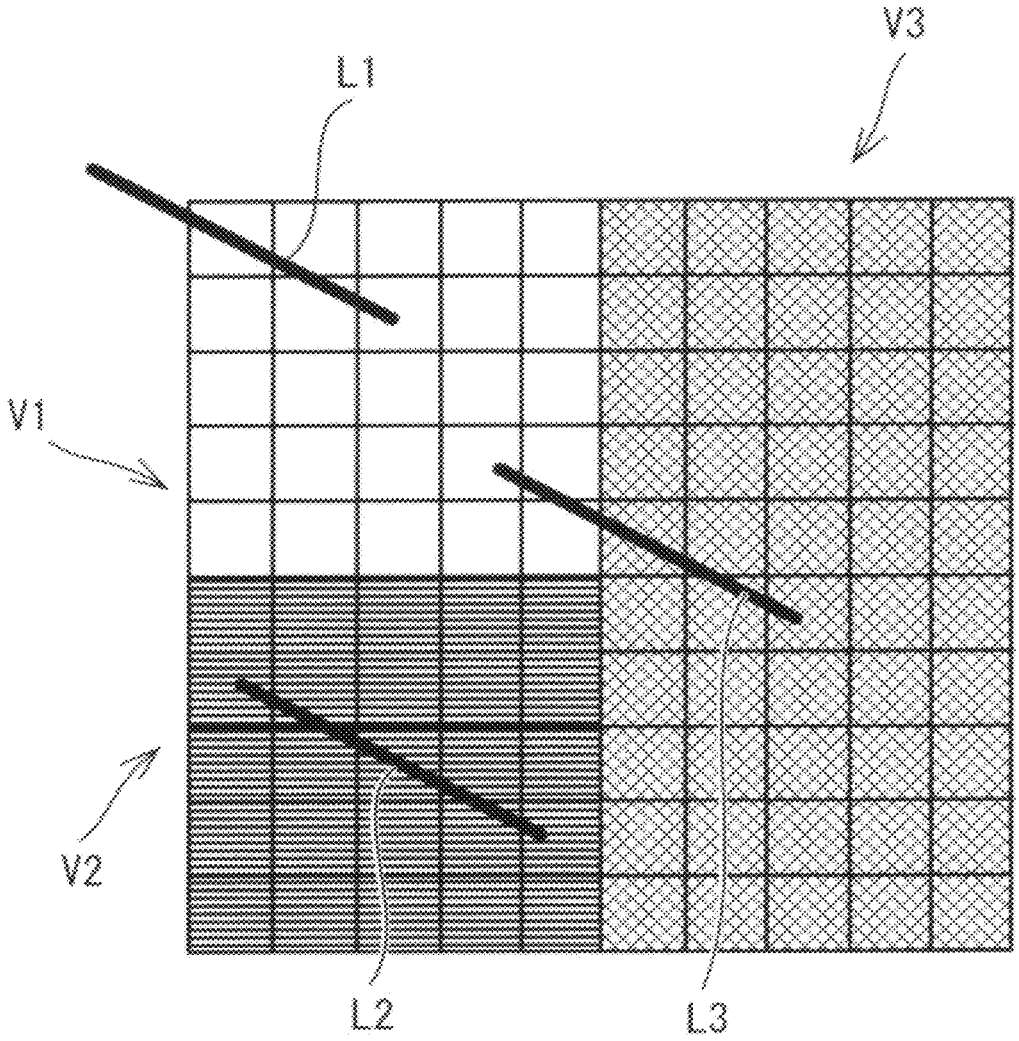
FIG. 10 is an explanatory diagram that illustrates processing that associates line segment data with divided areas.

Next, all the line segment data pieces generated at Step S30 are associated with the divided areas generated at Step S60 and the associated relationships between the line segment data pieces and the divided areas are stored in the association storage area 156 (Step S70). More specifically, it is determined which divided area is associated with the line segment data piece, based on which divided area includes a pixel corresponding to a center of a line segment indicated by the line segment data piece, namely, a target pixel corresponding to the line segment data piece. For example, let us assume that the whole area of the original image is divided at Step S60 into three divided areas V1, V2 and V3, as shown in FIG. 10. Additionally, let us assume that line segments L1, L2 and L3 are indicated by the line segment data pieces generated at Step S30. In this case, a center of the line segment L1 is positioned in the divided area V1, and thus, at Step S70, the line segment data piece for the line segment L1 is associated with the divided area V1. In a similar manner, the line segment data piece for the line segment L2 is associated with the divided area V2 and the line segment data piece for the line segment L3 is associated with the divided area V3.

Next, area thread color allocation processing is performed (Step S80). In the area thread color allocation processing, processing is performed to allocate at least one area thread color to each of the divided areas. In the area thread color allocation processing of the first embodiment, the at least one area thread color is allocated to each of the divided areas in accordance with the following first and second conditions. The first condition is that, when a color difference between the representative color of the divided area and an available thread color is smaller than a threshold value r1, the available thread color is allocated to the divided area as the area thread color. The second condition is that, when the number of area thread colors allocated to the divided area in accordance with the first condition is less than one, an available thread color is allocated to the divided area as the area thread color such that the color difference between the representative color of the divided area and the available thread color is a smallest value. Hereinafter, the area thread color allocation processing of the first embodiment will be explained in more detail with reference to FIG. 11.

Figure 11:
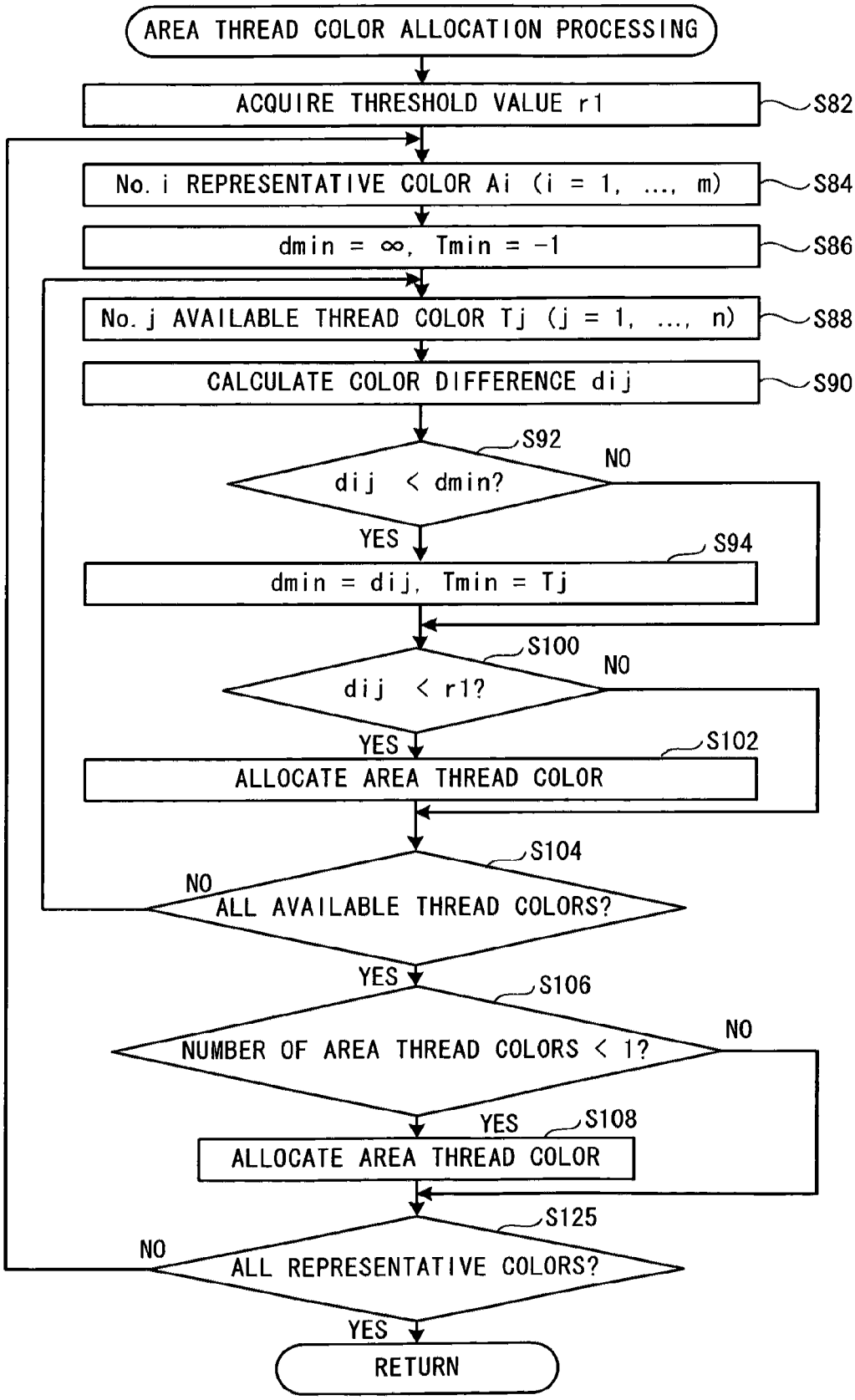
FIG. 11 is a flow chart of area thread color allocation processing.

As shown in FIG. 11, in the area thread color allocation processing, first the threshold value r1 is acquired, and the acquired threshold value r1 is stored in the RAM 12 (Step S82). The threshold value r1 will be used in the processing to allocate the area thread color to the divided area in accordance with the first condition. The threshold value r1 is a fixed value that is set in advance or a value input by the user. At Step S82, for example, 90 is acquired as the threshold value r1.

Next, a representative color Ai (No. i) stored in the representative color storage area 155 is read out, and the read representative color Ai is stored in the RAM 12 (Step S84). The numbers from 1 to the number m of representative colors are sequentially set as i. The initial value of i is 1, and when the processing at Step S84 is repeated, i is incremented. For example, when i is 1, the No. 1 representative color A1 (R, G, B)=(253, 251, 251) in FIG. 8 is read out.

Then, ∞ is set for dmin and −1 is set for Tmin, respectively, and the set dmin and Tmin are stored in the RAM 12 (Step S86). dmin indicates a smallest value among the color differences between the No. i representative color and the available thread colors. In the present embodiment, the color difference is expressed by a distance between the representative color and the available thread color represented by RGB values. Tmin indicates the number (No.) of the available thread color that has the dmin value.

Next, a j-th available thread color Tj (No. j) stored in the available thread color storage area 157 is read out and the read available thread color Tj is stored in the RAM 12 (Step S88). The numbers from 1 to the number n of available thread colors are sequentially set as j. The initial value of j is 1, and when the process at Step S88 is repeated, j is incremented. For example, when j is 1, the No. 1 available thread color T1 (R, G, B)=(240, 240, 240) in FIG. 7 is read out.

Next, a color difference dij between the representative color Ai read at Step S84 and the available thread color Tj read at Step S88 is calculated, and the color difference dij is stored in the RAM 12 (Step S90). More specifically, based on the RGB values representing each of the colors, a distance between the representative color Ai and the available thread color Tj is calculated as the color difference dij. For example, a color difference d11 between the representative color A1 and the available thread color T1 is calculated as 20.273 using an equation $\sqrt{\{(253-240)^2+(251-240)^2+(251-240)^2\}}$.

It is then determined whether the color difference dij calculated at Step S90 is smaller than dmin (Step S92). When the color difference dij is smaller than dmin (yes at Step S92), dij is set as dmin and Tj is set as Tmin, respectively, and the set dmin and Tmin are stored in the RAM 12 (Step S94).

When the color difference dij is not smaller than dmin (no at Step S92), or following Step S94, it is determined whether the color difference dij calculated at Step S90 is smaller than the threshold value r1 acquired at Step S82 (Step S100). When the color difference dij is smaller than the threshold value r1 (yes at Step S100), the available thread color Tj is stored in the area thread color storage area 158 as the area thread color for the divided area Vi associated with the representative color Ai (Step S102). By the processing at Step S102, the available thread color that satisfies the first condition is allocated to the divided area Vi as the area thread color. For example, when r1 is 90 and d11 is 20.273 (yes at Step S100), T1 is allocated as the area thread color of the divided area V1 associated with the representative color A1 (Step S102).

When the color difference dij is not smaller than the threshold value r1 (no at Step S100), or following Step S102, it is determined whether, with respect to the representative color Ai, all of the available thread colors Tj have been read out (Step S104). When at least one of the available thread colors Tj that has not yet been read out (no at Step S104), j is incremented, and the processing returns to Step S88.

When all of the available thread colors Tj have been read out (yes at Step S104), the area thread color storage area 158 is referred to and it is determined whether the number of area thread colors allocated to the divided area Vi is less than 1 (Step S106). When the number of the area thread colors is zero (yes at Step S106), Tmin is stored in the area thread color storage area 158 as the area thread color of the divided area Vi associated with the representative color Ai (Step S108). The processing at Step S108 is processing to ensure that, in accordance with the second condition, at least one available thread color is allocated as the area thread color to each of the divided areas.

When the number of area thread colors is one or more (no at Step S106), or following Step S108, it is determined whether all of the representative colors Ai have been read out (Step S125). When at least one of the representative colors Ai has not yet been read out (no at Step S125), i is incremented, and the process returns to Step S84. When all the representative colors Ai have been read out (yes at Step S125), the area thread color allocation processing is ended, and the processing returns to the main processing illustrated in FIG. 4. FIG. 12 shows an example of the area thread colors determined by the area thread color allocation processing of the first embodiment. In FIG. 12, numbers in the first (leftmost) column indicate the No. of the representative colors and the divided areas shown in FIG. 8, and numbers in the top row indicate the No. of the available thread colors shown in FIG. 7. Furthermore, in FIG. 12, a value in row S, column T indicates a color difference between a No. S representative color and a No. T available thread color. In FIG. 12, diagonal lines are added to the color difference that is determined at Step S100 to be smaller than the threshold value r1, and vertical lines are added to the color difference that is determined at Step S108 to be the smallest value of the color differences between the No. S representative color and the available thread colors. When the diagonal lines or the vertical lines are added to the value in row S, column T, this indicates that the available thread color No. T is allocated as the area thread color to the No. S divided area. As shown in FIG. 12, at least one available thread color is allocated to each of the divided area.

The explanation of the main processing will continue with reference to FIG. 4. After Step S80, the embroidery thread colors are sequentially determined for all the line segment data pieces generated at Step S30 and stored in the embroidery thread color storage area 159 (Step S130). More specifically, first, the line segment data storage area 153 is referred to and one of the line segment data pieces is read out. Then, the association storage area 156 is referred to, and the divided area associated with the read out line segment data piece (hereinafter sometimes referred to as the "target line segment data piece") is acquired. Next, the area thread color storage area 158 is referred to, and the at least one area thread color associated with the acquired divided area is acquired. Following this, the image data storage area 151 is referred to, and, based on the pixel data piece corresponding to the target line segment data piece, the embroidery thread color allocated to the target line segment data piece is determined from among the acquired at least one area thread color. For example, when the target line segment data piece is associated with the No. 1 divided area in FIG. 12, either the No. 1 or the No. 3 area thread color is determined as the embroidery thread color. The processing to determine the embroidery thread color from the at least one area thread color may be performed in accordance with any known technology. For example, the area thread color with the smallest color difference from the color of the target pixel used to generate the line segment data piece at Step S30 may be set as the color component of the target line segment data piece. Alternatively, the color component of the target line segment data piece may be set from the at least one area thread color while taking into account the color of other stitches in a sewing area corresponding to the divided area associated with the target line segment data piece.

Next, the line segment data storage area 153 and the embroidery thread color storage area 159 are referred to and connecting line segment data is generated. The generated connecting line segment data is stored in the line segment data storage area 153 (Step S140). The connecting line segment data piece is a data piece indicating a line segment (connecting line segment) that connects two of the line segments indicated by the line segment data pieces to which the same embroidery thread color is allocated. A variety of known methods may be adopted as a method to generate the connecting line segment data. For example, let us assume that one end of a No. k line segment indicated by the line segment data piece is a starting point and the other end is an ending point. A line segment is searched for that has an end closest to the ending point of the No. k line segment. The line segment that has been found in the search is set as the No. k+1 line segment. Then, the connecting line segment data piece for the connecting line segment that connects the No. k line segment and the No. k+1 line segment is generated. The above-described processing may be performed with respect to all the line segment data pieces associated with the same thread color, and a connecting sequence may be set such that the line segments indicated by the line segment data pieces are mutually connected by adjacent ends.

Figure 13:
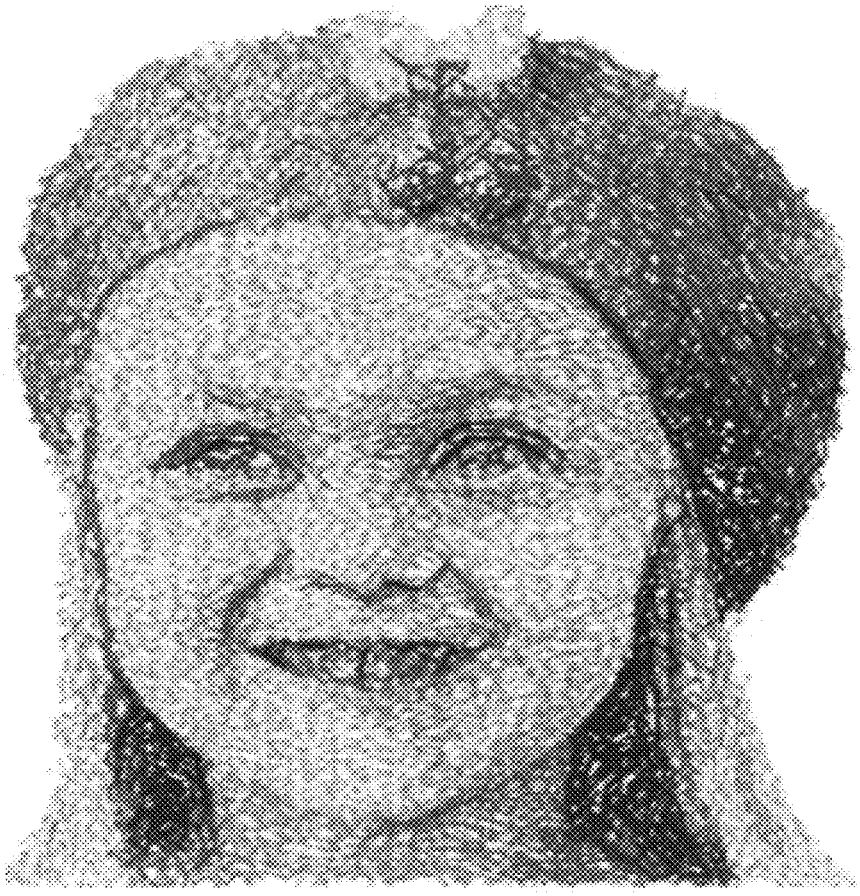
FIG. 13 is an explanatory diagram that illustrates an embroidery pattern that is formed based on embroidery data generated in accordance with the main processing.

Next, based on the line segment data and the connecting line segment data stored in the line segment data storage area 153, and the embroidery thread colors stored in the embroidery thread color storage area 159, the embroidery data is generated and the generated embroidery data is stored in the embroidery data storage area 160 (Step S150). The embroidery data includes a sewing order, thread color data and needle drop point data. A variety of known methods may be adopted as a method to generate the embroidery data. For example, starting points and ending points of the line segments indicated by the line segment data pieces for each of the same embroidery thread color are converted into stitch starting points and ending points. The stitch starting points and the stitch ending points are stored in association with the thread color in the sewing order. Furthermore, connecting line segment data processing is performed on starting points and ending points of the connecting line segments indicated by the connecting line segment data pieces, such that they are respectively converted into starting points and ending points of a running stitch or a jump stitch. The starting point and the ending point of the running stitch or the jump stitch are stored in association with the embroidery thread color in the sewing order. Following Step S150, the main processing is ended. For example, when an embroidery pattern is formed in accordance with the embroidery data generated using the image shown in FIG. 5 as the original image, the embroidery pattern shown in FIG. 13 is obtained.

The embroidery data generating apparatus 1 according to the first embodiment performs the main processing as described above. With the embroidery data generating apparatus 1 according to the first embodiment, the embroidery thread color that represents the color of the original image is determined from among the at least one area thread color allocated to each of the divided areas based on the color difference between the representative color and the available thread colors. In accordance with the first condition, in the processing at Step S100 in FIG. 11, when the color difference dij is smaller than the threshold value r1 (yes at Step S100), the available thread color Tj is determined as the area thread color (Step S102). Thus, in principle, a color that is far from the representative color is not set as the area thread color. As a result, the embroidery data generating apparatus 1 can avoid allocating an unnatural color that is far from the color of the original image to the line segment data piece as the embroidery thread color. For that reason, the embroidery data generating apparatus 1 can generate the embroidery data that can form the embroidery pattern representing the colors of the original image more accurately. Further, in the processing at Step S106 and Step S108 in FIG. 11, one or more of the area thread colors are reliably determined with respect to each of the divided areas. As a result, according to the embroidery data generating apparatus 1 of the first embodiment, it is possible to avoid a situation in which no area thread color is determined at all. At Step S106, a number that is compared to the number of the area thread colors can be changed appropriately depending on the number of the area thread colors that are to be determined. When the number that is compared to the number of the area thread colors is two or more, a plurality of the area thread colors can be reliably allocated to each of the divided areas. As a result, it is possible to reliably avoid a situation in which the number of the area thread colors is too small to represent the image using a color mixing sewing.

Figure 14:
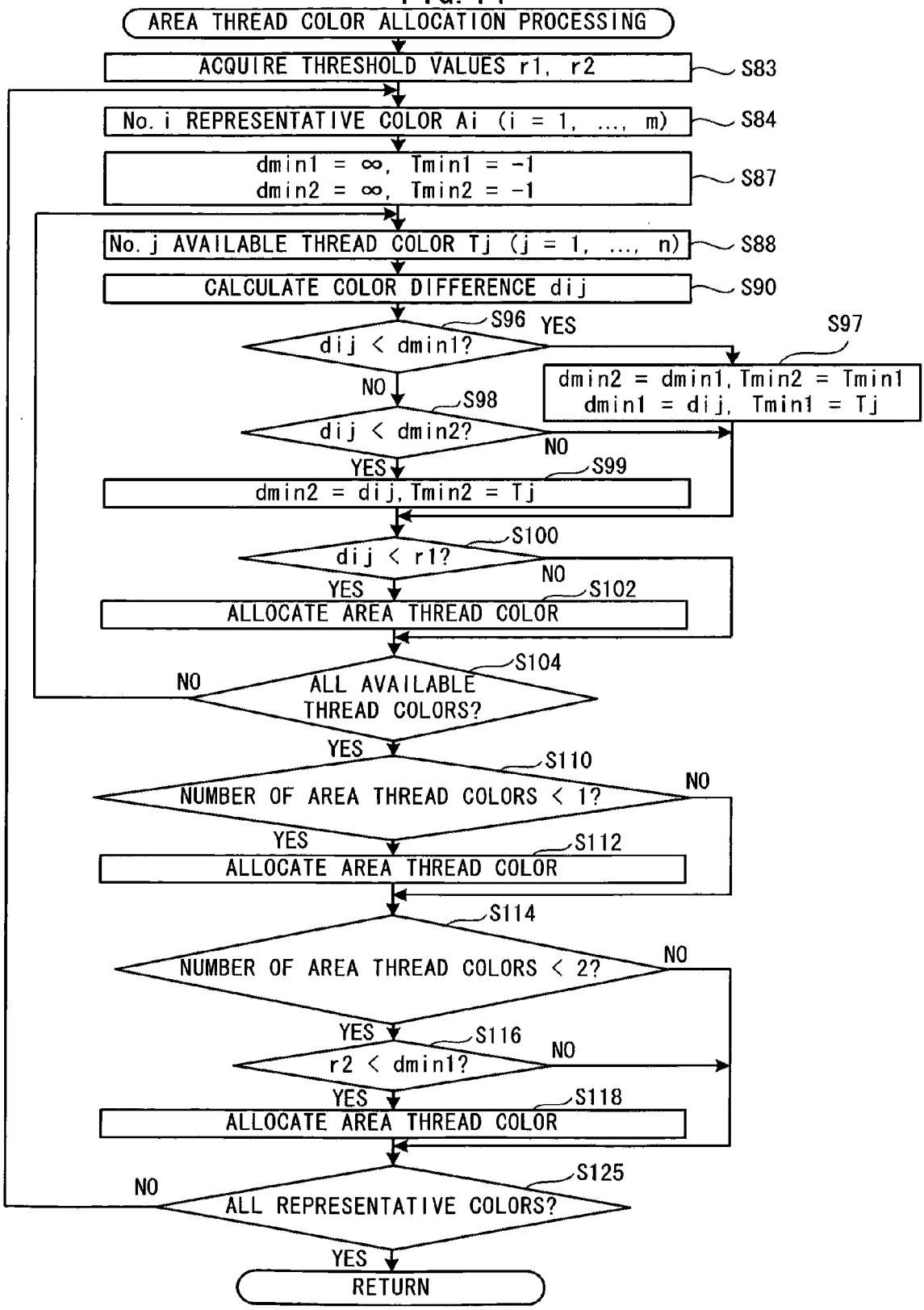
FIG. 14 is a flow chart of area thread color allocation processing.

Hereinafter, main processing of the embroidery data generating apparatus 1 according to a second embodiment will be explained. A difference between the main processing of the embroidery data generating apparatus 1 according to the second embodiment and the main processing of the first embodiment shown in FIG. 4 is the area thread color allocation processing at Step S80, and the remaining processing is the same. An explanation is omitted of the processing that is the same as the main processing of the first embodiment, and area thread color allocation processing of the second embodiment is explained with reference to FIG. 14. In FIG. 14, the same step numbers are attributed to the processing that is the same as the area thread color allocation processing of the first embodiment illustrated in FIG. 11.

In the area thread color allocation processing of the second embodiment, at least one area thread color is allocated to each of the divided areas in accordance with the first condition, the second condition and a third condition. The first condition and the second condition are the same as the first condition and the second condition of the area thread color allocation processing of the first embodiment. The third condition is that, when the number of area thread colors already allocated to the divided area in accordance with the first condition and the second condition is smaller than two, and also the color difference between the representative color and the already allocated area thread color is larger than a threshold value r2, a new area thread color is allocated to the divided area. With the third condition, among the available thread colors that have not been allocated as the area thread color, the available thread color that has the smallest color difference with the representative color is allocated as the new area thread color.

As shown in FIG. 14, the area thread color allocation processing of the second embodiment differs from the area thread color allocation processing of the first embodiment in that Step S83, Step S87, Step S96 to Step S99 and Step S110 to Step S118 are performed in place of Step S82, Step S86, Step S92, Step S94, Step S106 and Step S108. An explanation of the processing that is the same as that of the area thread color allocation processing of the first embodiment is omitted here, and processing performed at Step S83, Step S87, Step S96 to Step S99 and Step S110 to Step S118 will be explained. The area thread color allocation processing of the second embodiment illustrated in FIG. 14 is executed by the CPU 11, in accordance with the embroidery data generating program stored in the program storage area 161 of the HDD 15.

At Step S83, the threshold value r1 and the threshold value r2 are acquired and stored in the RAM 12 (Step S83). The threshold value r2 will be used in processing to allocate the area thread color to the divided area in accordance with the third condition. More specifically, when only one area thread color is allocated to one of the divided areas, the threshold value r2 will be used in processing to determine whether the color of the image can be sufficiently represented by the one area thread color. Accordingly, the threshold value r2 is a smaller value than the threshold value r1. The threshold value r1 and the threshold value r2 are fixed values set in advance or are values input by the user. For example, 90 is acquired as the threshold value r1 and 50 is acquired as the threshold value r2.

At Step S87, ∞ is set for dmin1 and dmin2, and −1 is set for Tmin1 and Tmin2, respectively. The set values are stored in the RAM 12 (Step S87). dmin1 indicates a smallest value among the color differences between the representative color and the available thread colors, while dmin2 indicates a second smallest value among the color differences between the representative color and the available thread colors. Tmin1 indicates the No. of the available thread color that has the dmin1 value and Tmin2 indicates the No. of the available thread color that has the dmin2 value.

At Step S96, it is determined whether the color difference dij calculated at Step S90 is smaller than dmin1 (Step S96). When the color difference dij is smaller than dmin1 (yes at Step S96), dmin1 is set as dmin2, Tmin1 is set as Tmin2, dij is set as dmin1 and Tj is set as Tmin1, respectively, and the set values are stored in the RAM 12 (Step S97).

When the color difference dij is not smaller than dmin1 (no at Step S96), it is determined whether the color difference dij is smaller than dmin2 (Step S98). When the color difference dij is smaller than dmin2 (yes at Step S98), dij is set as dmin2 and Tj is set as Tmin2, respectively, and the set values are stored in the RAM 12 (Step S99). When the color difference dij is not smaller than dmin2 (no at Step S98), after Step 97 or Step S99, Step S100 is performed in the same way as in the first embodiment.

At Step S110, the area thread color storage area 158 is referred to, and it is determined whether the number of area thread colors associated with the divided area Vi (representative color Ai) is smaller than one (Step S110). When the number of area thread colors is smaller than one (yes at Step S110), Tmin1 is stored in the area thread color storage area 158 as the area thread color (Step S112). The processing at Step S112 is processing in which the area thread color is allocated to the divided area Vi in accordance with the second condition.

When the number of area thread colors is one or more (no at Step S110), or following Step S112, the area thread color storage area 158 is referred to and it is determined whether the number of area thread colors associated with the divided area Vi (representative color Ai) is smaller than two (Step S114). When the number of area thread colors is one (yes at Step S114), it is determined whether dmin1 is larger than the threshold value r2 (Step S116). When dmin1 is larger than the threshold value r2 (yes at Step S116), Tmin2 is stored in the area thread color storage area 158 as the area thread color of the divided area Vi (Step S118). The processing at Step S118 is processing in which the area thread color is allocated to the divided area Vi in accordance with the third condition. When, the number of area thread colors is two or more (no at Step S114), or when, dmin1 is not larger than the threshold value r2 (no at Step S116), or following Step S118, Step S125 is performed in the same way as in the first embodiment.

The embroidery data generating apparatus 1 according to the second embodiment performs the main processing as described above. An example will be explained with reference to FIG. 15 in which the area thread color is determined by the area thread color allocation processing according to the second embodiment. A notation method in FIG. 15 is substantially the same as in FIG. 12. However, in FIG. 15, vertical lines are added to the color difference that is determined, at Step S112 in FIG. 14, to be the smallest value of the color differences between the No. S representative color and the available thread colors. Horizontal lines are added to the color difference that is determined, at Step S118, to be the second smallest color difference between the No. S representative color and the available thread colors. When diagonal lines, vertical lines or horizontal lines are added to the value in row S, column T, this indicates that the No. T available thread color is allocated to the No. S divided area as the area thread color. Under the conditions r1=90 and r2=50, the new area thread colors determined at Step S118 (to which horizontal lines are added in FIG. 15) are allocated to the divided areas No. 5, No. 8 and No. 10 (yes at Step 114 and yes at Step S116). However, the new area thread color is not allocated to the divided area No. 4 (yes at Step S114, no at Step S116).

Depending on the area thread color allocation conditions, the number of area thread colors allocated to the divided area based on the first condition and the second condition may be extremely small. In the area thread color allocation processing according to the second embodiment, when the number of area thread colors allocated to the divided area based on the first condition and the second condition is one, and when the color difference between the one area thread color and the representative color of the divided area is larger than r2, processing is performed that further increases the number of the area thread colors. When the color difference between the area thread color and the representative color of the divided area is equal to or smaller than r2, it is conceivable that the color of the pixels within the divided area can be sufficiently represented by the area thread color allocated based on the first condition and the second condition. In a case in which the color difference between the area thread color and the representative color of the divided area is larger than r2, it is conceivable that the color of the pixels within the divided area cannot be represented by the already determined area thread color alone. By determining the embroidery thread color using the at least one area thread color determined in the above-described way, the embroidery data generating apparatus 1 can generate embroidery data that forms the embroidery pattern more accurately representing the colors of the original image.

Hereinafter, main processing according to a third embodiment will be explained. The main processing of the third embodiment is different from the main processing of the first and the second embodiments in that, in the processing performed at Step S150 in FIG. 4, it is determined whether a running stitch or a jump stitch is to be formed on the connecting line segment. In other respects, the processing is the same. An explanation is omitted of the processing that is the same as the main processing of the first and the second embodiments, and hereinafter connecting line segment processing of the third embodiment is explained with reference to FIG. 16. The connecting line segment processing in FIG. 16 is executed by the CPU 11 in accordance with the embroidery data generating program stored in the program storage area 161 of the HDD 15.

Figure 16:
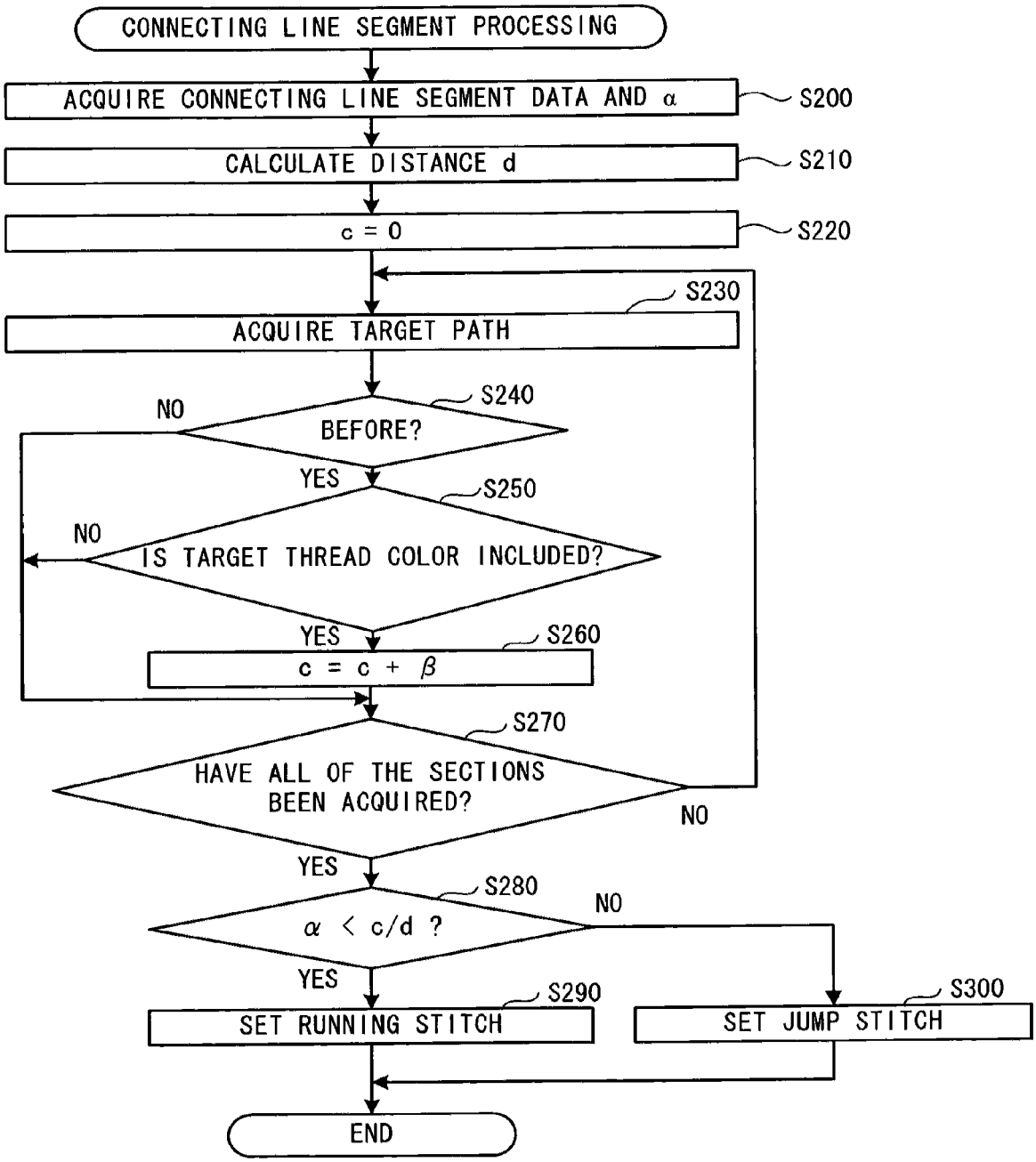
FIG. 16 is a flow chart of connecting line segment processing.

In the process of generating the embroidery data, the connecting line segment processing in FIG. 16 is performed after the sewing order is determined for each embroidery thread color. Furthermore, with respect to all the connecting line segment data pieces stored in the line segment data storage area 153, the connecting line segment processing is sequentially performed by each embroidery thread color (hereinafter sometimes referred to as the "target thread color") associated with the line segment data that are connected by the connecting line segment data.

Figure 17:
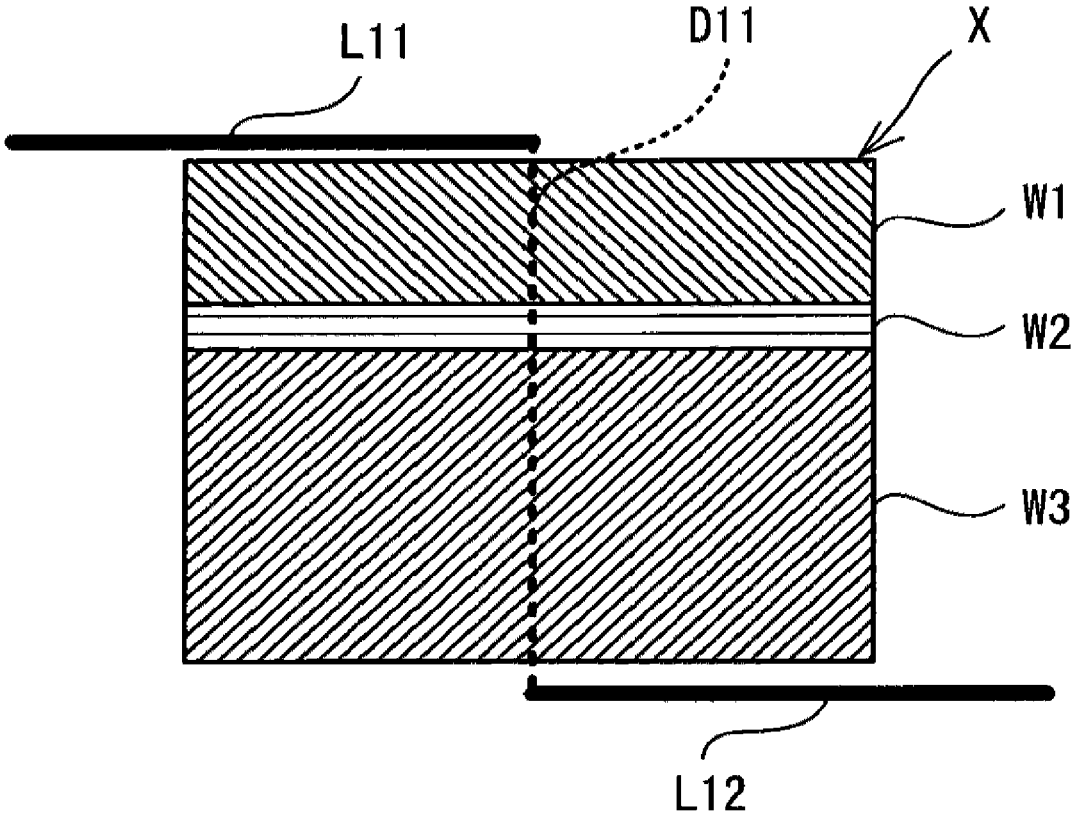
FIG. 17 is an explanatory diagram that illustrates a connecting line segment D11 that connects a line segment L11 and a line segment L12.

As shown in FIG. 16, first, the connecting line segment data piece and a threshold value $\alpha$ are acquired and stored in the RAM 12 (Step S200). The threshold value $\alpha$ will be used in processing that determines whether a running stitch or a jump stitch is to be formed on the connecting line segment. The threshold value $\alpha$ is a fixed value set in advance or is a value input by the user. At Step S200, for example, the connecting line segment data piece is acquired that indicates the connecting line segment D11 that connects the line segment L11 and the line segment L12 shown in FIG. 17.

Next, a distance d is calculated that is a distance from a starting point P1 to an ending point P2 of the connecting line segment indicated by the connecting line segment data piece acquired at Step S200 as a length of a target stitch, and the distance d is stored in the RAM 12 (Step S210). The target stitch is defined as a stitch to be formed on the connecting line segment represented by the connecting line segment data piece acquired at Step S200. Then, zero is set as c, and c is stored in the RAM 12 (Step S220). c is a variable that is used to count a length of a section in which a specific intersecting stitch is distributed. The specific intersecting stitch is an intersecting stitch that satisfies the following two conditions. The intersecting stitch is a stitch that intersects with the target stitch. A first condition is a condition under which a sewing order of the intersecting stitch is later than that of the target stitch. A second condition is a condition under which the at least one area thread color allocated to the divided area corresponding to the specific intersecting stitch includes the embroidery thread color of the target stitch. Then, of a path from the starting point P1 to the ending point P2 of the connecting line segment indicated by the connecting line segment data piece, a section from a first point to a second point is acquired as a target path (Step S230). A distance from the starting point P1 to the first point is $\theta$. A distance from the starting point P1 to the second point is $\theta+\beta$. An initial value of $\theta$ is zero. $\beta$ is a fixed value set in advance or a value input by the user.

Next, the line segment data storage area 153 is referred to, and, it is determined whether the target stitch will be sewn before the intersecting stitch that intersects with a stitch (hereinafter sometimes referred to as a "section stitch") on the target path acquired at Step S230, when the embroidery data to form the section stitch is generated (Step S240). The section stitch is a part of the target stitch. A length of the section stitch is $\beta$. For explanatory convenience, it is assumed that the length $\beta$ is a length in which at most one intersecting stitch can be formed. At Step S240, the sewing order of the intersecting stitch is compared with the sewing order of the target stitch based on a sewing order corresponding to each of the embroidery thread color and a connecting order of the line segment represented by the line segment data piece or the connecting line segment represented by the connecting line segment data piece.

When the target stitch is to be sewn before the intersecting stitch (yes at Step S240), the association storage area 156 and the area thread color storage area 158 are referred to and it is determined whether the target thread color is included in the at least one area thread color of the divided area corresponding to the intersecting stitch (step S250). When the target thread color is included (yes at Step S250), the intersecting stitch is specified as a specific intersecting stitch. In this case, after c is increased by $\beta$, c is stored in the RAM 12 (Step S260). Processing at Step S260 is processing that counts the length of the section of the target stitch in which the specific intersecting stitch is distributed. When the target thread color is included in the at least one area thread color of the divided area corresponding to the intersecting stitch to be sewn later than the target stitch, the intersecting stitch of the target thread color may be formed in the sewing area. Accordingly, even if a stitch of the target thread color is formed on the target path, it is assumed that there is no adverse effect on the appearance of the embroidery pattern. By obtaining c in the above-described manner, the embroidery data generating apparatus 1 can calculate the length of the section of the connecting line segment at which it is assumed that a running stitch has no adverse effect on the appearance of the embroidery pattern, when the running stitch is formed on the connecting line segment. For example, in the example shown in FIG. 17, the area that the connecting line segment D11 will pass through is a passing area X. The passing area X includes sewing areas W1, W2 and W3. It is assumed that when a stitch is formed on the connecting line segment D11, the sewing order of the stitch (the target stitch) will be earlier than that of stitches (the intersecting stitches) that intersect with the target stitch and that are formed in the sewing areas W1, W2 and W3 (yes at Step S240). When the target thread color is included in the at least one area thread color of each of the divided areas corresponding to the sewing areas W1 and W3 but the target thread color is not included in the at least one area thread color of the divided area corresponding to the sewing area W2, c indicates the total length of the sections of the connecting line segment D11 that pass through the sewing areas W1 and W3, respectively.

When the target stitch is to be sewn after the intersected stitch (no at Step S240), or when the target thread color is not included (no at Step S250), or following Step S260, the process advances to Step S270. At Step S270, it is determined whether all of the sections from the starting point P1 to the ending point P2 of the connecting line segment indicated by the connecting line segment data piece have been acquired as the target path (Step S270). When at least one of the sections has not been acquired (no at Step S270), after θ is increased by β, θ is stored in the RAM 12 and the process returns to Step S230. When all of the sections have been acquired (yes at Step S270), it is determined whether c/d is larger than α (Step S280). When c/d is larger than α (yes at Step S280), needle drop point data is generated that causes a running stitch to be formed on the connecting line segment indicated by the connecting line segment data piece acquired at Step S200, and the needle drop point data is stored in the embroidery data storage area 160 (Step S290). When c/d is not larger than α (no at Step S280), needle drop point data is generated that causes a jump stitch to be formed on the connecting line segment indicated by the connecting line segment data piece acquired at Step S200, and the needle drop point data is stored in the embroidery data storage area 160 (Step S300). Following Step S290 or Step S300, the connecting line segment processing is ended.

According to the connecting line segment processing of the third embodiment, depending on a ratio of the length c to the length d, the embroidery data for a running stitch or a jump stitch to be sewn on the connecting line segment is generated. The length c is the length of the section of the target stitch in which at least one specific intersecting stitch is distributed. The length d is the length of the target stitch corresponding to the connecting line segment. The threshold value α to determine whether the running stitch is to be sewn on the connecting line segment is set as appropriate, taking into account sewing time and quality of the embroidery pattern. Accordingly, the embroidery data generating apparatus 1 can generate the embroidery data while taking into account an adverse effect on the appearance of the embroidery pattern that may be caused when an unnatural color that is far from the color of the image is visible between the stitches covering the stitch formed on the connecting line segment.

The embroidery data generating apparatus according to the present disclosure is not limited to the above-described embodiments, and various modifications may be employed insofar as they are within the scope of the present disclosure. For example, the following modified examples (A) to (I) may be employed as appropriate.

(A) In the above-described exemplary embodiments, the embroidery data generating apparatus 1 is a personal computer, but a sewing machine (for example, the embroidery sewing machine 3) on which the embroidery data generating program is stored may generate the embroidery data.

(B) In the above-described exemplary embodiments, in the main processing shown in FIG. 4, the line segment data is generated based on the angular characteristic data calculated from the pixel data, but the line segment data may be generated in accordance with another known line segment data generating method. The embroidery data generating apparatus may use, as the line segment data, the stitch data disclosed in, for example, Japanese Laid-Open Patent Publication No. 2000-288275, the relevant portions of which are herein incorporated by reference.

(C) With the embroidery data generating apparatus of the above-described exemplary embodiments, a distance in an RGB color space is used as the color difference, but the color difference may be another difference between a plurality of colors as long as it is represented as a numerical value. For example, the color difference may be obtained using other color spaces, such as "HIS," "HSV," or "Lab" etc. A value other than the distance in the color space may also be used as the color difference. For example, the color difference may be a hue in an HSV color space that is represented as an angle in a range of 0 to 360 degrees.

(D) With the embroidery data generating apparatus of the above-described exemplary embodiments, the representative color of the divided area is determined by performing the color reduction processing on the original image. The median cut algorithm is given as an example of the color reduction method, but other methods may be adopted, such as a uniform quantization method, a tapered quantization method and so on. Furthermore, the representative color may be determined by another method. For example, the representative color may be determined based on an average RGB value. Alternatively, the representative color may be determined as a color that is included to the greatest extent within the divided area. Similarly, in the above-described exemplary embodiments, for ease of explanation, it is assumed that pixels having the same color as a result of color reduction belong to the same divided area. Alternatively the embroidery data generating apparatus may, for example, set, as the same divided area, areas in which pixels having the same color as a result of color reduction are contiguous.

(E) With the embroidery data generating apparatus according to the second embodiment, when, in accordance with the third condition, the smallest value of the color differences between the at least one area thread color and the representative color of the divided area is larger than the threshold value r2 (yes at Step S116 in FIG. 14), the processing is performed to add, as the area thread color, the available thread color that has the second smallest color difference with the representative color (step S118). However, a condition to determine a new area thread color can be modified as appropriate. For example, as a fourth condition, when the number of already determined area thread colors is one or more, a condition may be adopted in which the new area thread color is determined while taking into account the already determined area thread color, in addition to the representative color. More specifically, the embroidery data generating apparatus may determine the new area thread color such that it can represent the color close to the representative color by color mixing sewing using the already determined area thread color and the newly determined area thread color. In a similar manner, criteria to determine whether the new area thread color is allocated to the divided area can be modified as appropriate. For example, as a fifth condition, processing may be performed that determines the new area thread color when a degree of change in the color of the divided area is larger than a threshold value r3. In the modified example (E), the new area thread color can be determined, for example, using the following procedure.

Figure 18:
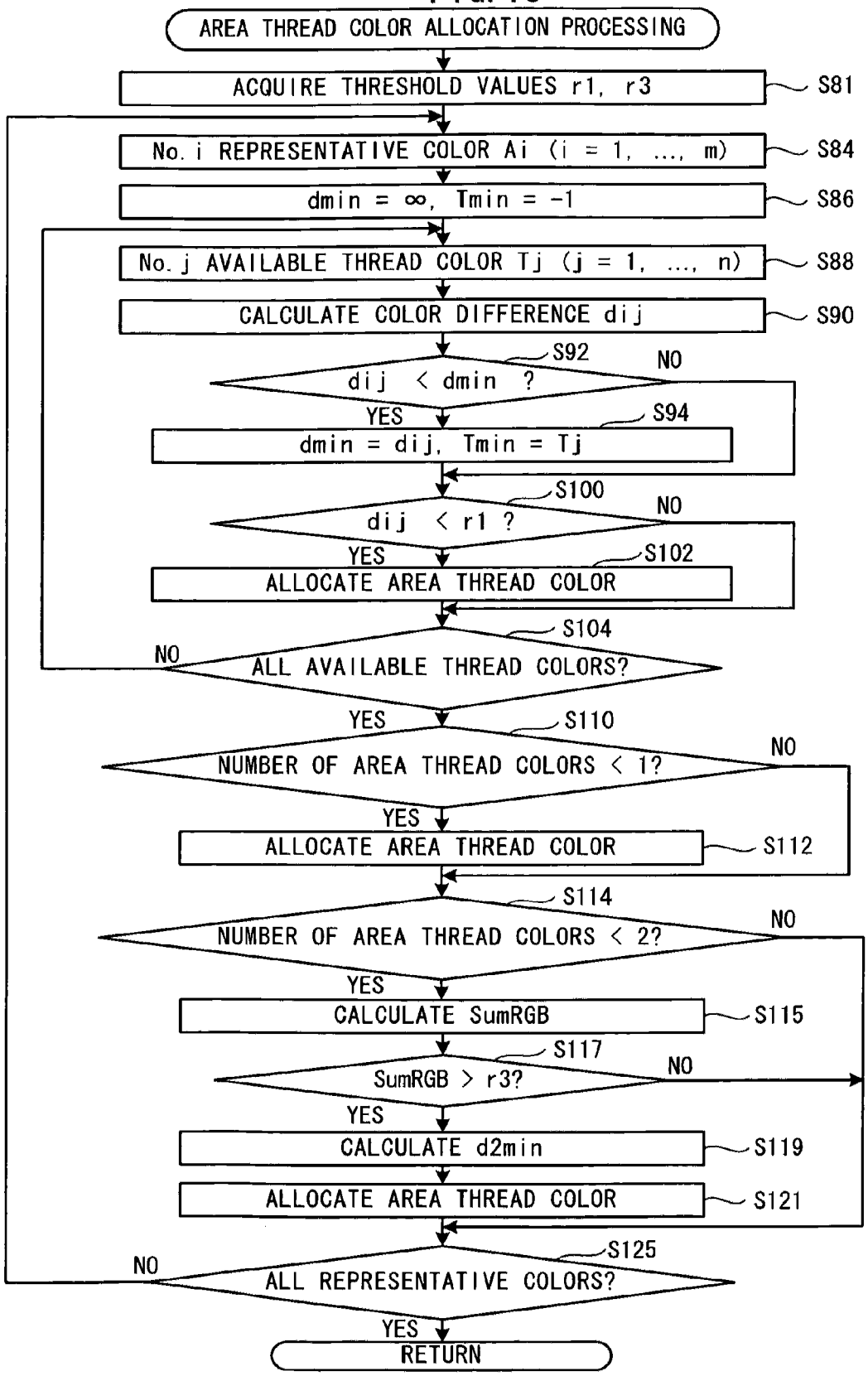
FIG. 18 is a flow chart of area thread color allocation processing.

As the modified example (E), area thread color allocation processing will be explained with reference to FIG. 18. In the area thread color allocation processing of the modified example (E), at least one area thread color is allocated to each of the divided areas in accordance with the first, fourth and fifth conditions. The same step numbers are attributed to the processing in FIG. 18 that is the same as that of the area thread color allocation processing of the first embodiment in FIG. 11 and of the area thread color allocation processing of the second embodiment in FIG. 14. As shown in FIG. 18, the area thread color allocation processing of the modified example (E) is different from the area thread color allocation processing of the first embodiment in that Step S81 and Step S110 to Step S121 are performed in place of Step S82, Step S106 and Step S108. Additionally, of the processing that differs from the area thread color allocation processing of the first embodiment, Step S110 to Step S114 are the same as the area thread color allocation processing of the second embodiment. An explanation is here omitted of the processing that is the same as the area thread color allocation processing of the first and second embodiments, and Step S81, Step S115 and Step S117 to Step S121 are explained hereinafter. The area thread color allocation processing of the modified example (E) in FIG. 18 is executed by the CPU 11 in accordance with the embroidery data generating program stored in the program storage area 161 of the HDD 15.

At Step S81, the threshold values r1 and r3 are acquired and the threshold values r1 and r3 are stored in the RAM 12. The threshold value r3 is used to determine whether the new area thread color will be allocated in accordance with the fifth condition. The threshold value r3 is a fixed value that is set in advance or is a value that is input by the user.

At Step S115, a SumRGB is calculated and the SumRGB is stored in the RAM 12 (Step S115). The SumRGB is a sum of absolute values of differences of RGB values that are calculated with respect to the No. i representative color of the No. i divided area and the colors of the pixels (hereinafter sometimes referred to as "corresponding pixels") included in the No. i divided area. The larger the SumRGB, in comparison with when the SumRGB is smaller, the larger the color difference between the No. i representative color and the colors of the corresponding pixels. The SumRGB may be calculated using the following procedure. For example, let us assume that the No. i representative color is represented as (R, G, B)=(Ra, Ga, Ba), there is a number z of the corresponding pixels, and the color of each of the corresponding pixels is represented as (R, G, B)=(Rg1, Gg1, Bg1), (Rg2, Gg2, Bg2), . . . , (Rgz, Ggz, Bgz). With respect to each of the RGB values, the sum of the absolute values of the differences between the No. i representative color and the colors of the corresponding pixels is calculated as described below. For example, for the R value of the RGB values, using the equation $SumR=|Ra-Rg1|+|Ra-Rg2|+\ldots+|Ra-Rgz|$, the sum of the absolute values of the differences between the No. i representative color and the colors of the corresponding pixels is obtained. The sum is calculated in a similar manner, for the G and B values of the RGB values. Next, the SumRGB=SumR+SumG+SumB is calculated, which is the sum of the absolute values of the differences between the No. i representative color and the colors of the corresponding pixels calculated for each of the RGB values.

At Step S117, it is determined whether the total value SumRGB calculated at Step S115 is larger than the threshold value r3 acquired at Step S81 (Step S117). When the SumRGB is larger than the threshold value r3 (yes at Step S117), the processing is performed that allocates the new area thread color to the No. i divided area. More specifically, first, d2min is calculated and d2min is stored in the RAM 12 (Step S119). d2min is a smallest value of the color differences between a color (Rx, Gx, Bx) and the available thread colors that have not been allocated to any of the divided areas. The color (Rx, Gx, Bx) may be calculated from the No. i representative color and the already determined area thread color in the following manner. Let us assume that the representative color is (R, G, B)=(Ra, Ga, Ba) and the already determined area thread color is (R, G, B)=(Rt, Gt, Bt). The color (Rx, Gx, Bx) is calculated as $Rx=Ra\times2-Rt$, $Gx=Ga\times2-Gt$ and $Bx=Ba\times2-Bt$. Next, the available thread color that has the d2min value is stored in the area thread color storage area 158 as the area thread color of the No. i divided area (Step S121). When the SumRGB is equal to or less than the threshold value r3 (no at Step S117), or following Step S121, Step S125 is performed in the same manner as in the first embodiment.

The area thread color allocation processing of the modified example (E) is performed in the above-described manner. In the modified example (E), the new area thread color may be determined by a similar procedure even when there is a plurality of the already determined area thread colors. In the modified example (E), the area thread color is determined while taking into account the already determined area thread colors, and thus, the embroidery data can be generated that forms the embroidery pattern that can more accurately represent the colors of the image by color mixing sewing with the area thread colors. Furthermore, when the color of the corresponding pixels changes within the same divided area, a situation can be avoided in which the change cannot be sufficiently represented by the embroidery pattern due to a small number of the area thread colors. The characteristic amount to determine the degree of change of color of the divided area can be changed as appropriate, and may be, for example, a value using spatial frequency in place of the above-described SumRGB.

(F) In the second and third embodiments, when the number of area thread colors is one (yes at Step S114) in FIG. 14 or FIG. 18, the processing is performed that allocates the second area thread color to the divided area. Alternatively, when the number of area thread colors is k, processing may be performed that allocates the No. k+1 area thread color to the divided area.

(G) A predetermined condition used in area thread color allocation processing can be changed as appropriate. For example, the above-described first to fifth conditions may be combined as appropriate. For example, the area thread colors from the second area thread color onwards may be determined by combining the first condition and the fourth condition. Alternatively, the area thread color allocation processing may be performed using another condition. In accordance with another condition, for example, a predetermined number of available thread colors may be determined as the area thread colors in ascending order of the color differences between the No. i representative color and the available thread colors, and may be assigned to the divided area corresponding to No. i representative color.

(H) In the third embodiment, the connecting line segment processing may be modified appropriately. For example, the processing may be performed in the following manner. First, it may be determined whether a predetermined ratio of intersecting stitches are set to be sewn after the target stitch. When the predetermined ratio of intersecting stitches are set to be sewn after the target stitch, it may be determined whether, within the length of the connecting line segment, the ratio of the section in which the target thread color is included in the at least one area thread color of the divided area corresponding to the intersecting stitch is larger than the threshold value $\alpha$. When the ratio is larger than the threshold value $\alpha$, needle drop point data is generated that causes a running stitch to be formed on the connecting line segment. In cases other than this, needle drop point data is generated that causes a jump stitch to be formed on the connecting line segment. The cases other than this may be a case in which the predetermined ratio of intersecting stitches are not to be sewn after the target stitch, and a case in which the predetermined ratio of intersecting stitches are to be sewn after the target stitch and, with respect to the length of the connecting line segment, the ratio of the section in which the target thread color is included in the at least one area thread color of the divided area corresponding to the intersecting stitch is equal to or less than the threshold value α. Other processing may be performed, for example, in a similar manner to the third embodiment.

(I) In the third embodiment, of the connecting line segment, depending on the length c of the section passing through the sewing area that includes the target thread color as the area thread color (yes at Step S280 in FIG. 16), needle drop point data is generated that a causes running stitch to be sewn on the connecting line segment (Step S290). Alternatively, for example, needle drop point data may be generated that causes a running stitch to be sewn on the connecting line segment when the connecting line segment only passes through the sewing area that includes the target thread color as the area thread color. In contrast, needle drop point data may be generated that causes a jump stitch to be formed when passing through the sewing area that does not include the target thread color. Furthermore, in the third embodiment, at Step S280, c/d is compared to the threshold value α (yes at Step S280), but needle drop point data that causes a running stitch to be sewn on the connecting line segment may be generated depending on a result of comparing c and the threshold value α

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generating apparatus comprising:

a thread color acquisition device that acquires, as a plurality of available thread colors, colors of threads to be used in sewing an embroidery pattern;

a line segment data generating device that generates line segment data, each piece of the line segment data representing a position of a line segment that corresponds to a target pixel, the target pixel being at least one of pixels represented by pixel data included in image data;

a dividing device that, based on the pixel data, divides a whole area of an image represented by the image data into a plurality of divided areas;

a determining device that, based on the pixel data corresponding to pixels within each of the divided areas, determines a representative color for each of the divided areas generated by the dividing device;

an area thread color allocating device that compares the representative color for each of the divided areas determined by the determining device with the available thread colors acquired by the thread color acquisition device, and allocates to each of the divided areas at least one of the available thread colors that satisfies a predetermined condition, as at least one area thread color;

an associating device that, based on a position, in the image, of the target pixel corresponding to each piece of the line segment data, generates an associated relationship between each piece of the line segment data generated by the line segment data generating device and one of the divided areas generated by the dividing device;

an embroidery thread color allocating device that, based on the associated relationship generated by the associating device and an allocation result obtained by the area thread color allocating device, allocates to each piece of the line segment data one of the at least one area thread color that represents the color of the target pixel corresponding to each of the line segment data, as an embroidery thread color;

a connecting line segment data generating device that, when a same thread color is allocated as the embroidery thread color to plural pieces of the line segment data by the embroidery thread color allocating device, generates connecting line segment data, each piece of the connecting line segment data representing a connecting line segment to connect two line segments respectively represented by two of the plural pieces of line segment data; and an embroidery data generating device that generates embroidery data including a sewing order, thread color data and needle drop point data, based on the line segment data generated by the line segment data generating device, the embroidery thread color allocated to each piece of the line segment data by the color allocating device and the connecting line segment data generated by the connecting line segment data generating device.

2. The embroidery data generating apparatus according to claim 1, wherein the area thread color allocating device allocates to each of the divided areas at least one of the available thread colors that satisfies a first condition, as the at least one area thread color, the first condition being a condition under which a color difference between the at least one of the available thread colors and the representative color is smaller than a first threshold value.

3. The embroidery data generating apparatus according to claim 2, wherein when a number of the at least one area thread color allocated to any one of the divided areas in accordance with the first condition is smaller than a predetermined number, the area thread color allocating device allocates, from among the available thread colors that have not been allocated as the at least one area thread color, to the any one of the divided areas at least one of the available thread colors that satisfies a second condition, as the at least one area thread color, the second condition being a condition under which a color difference between the at least one of the available thread colors and the representative color of the any one of the divided areas is a minimum.

4. The embroidery data generating apparatus according to claim 2, wherein when a color difference between the at least one area thread color allocated to any one of the divided areas in accordance with the first condition and the representative color is larger than a second threshold value, in addition to the at least one area thread color already allocated to the any one of the divided areas, the area thread color allocating device allocates, from among the available thread colors that have not been allocated as the at least one area thread color, to the any one of the divided areas at least one of the available thread colors that satisfies a second condition, as the at least one area thread color, the second condition being a condition under which a color difference between the at least one of the available thread colors and the representative color of the any one of the divided areas is a minimum.

5. The embroidery data generating apparatus according to claim 1, wherein when the at least one area thread color is already allocated to any one the divided areas, the area thread color allocating device, based on the at least one area thread color allocated to the any one of the divided areas and on the representative color, allocates to the any one of the divided areas at least one of the available thread colors that satisfies a first condition, as the at least one area thread color, the first condition being a condition under which the at least one of the available thread colors is selected from among the available thread colors that have not yet been allocated as the at least one area thread color.

6. The embroidery data generating apparatus according to claim 1, wherein the area thread color allocating device allocates at least a predetermined number of the available thread colors to each of the divided areas as the at least one area thread color, the predetermined number corresponding to a characteristic amount calculated based on color differences between the representative color of each of the divided areas and colors of pixels included in each of the divided areas.

7. The embroidery data generating apparatus according to claim 1, wherein the embroidery data generating device includes a needle drop point data generating device that generates, as needle drop point data corresponding to a piece of the connecting line segment data, data that causes a running stitch to be sewn on the connecting line segment represented by the piece of the connecting line segment data, when the piece of the connecting line segment data satisfies a first condition, and that generates, as the needle drop point data corresponding to the piece of the connecting line segment data, data that causes a jump stitch to be sewn on the connecting line segment represented by the piece of the connecting line segment data, when the piece of the connecting line segment data does not satisfy the first condition, the first condition being a condition under which a length of a section of a target stitch satisfies a predetermined condition, the target stitch being a stitch to be formed on the connecting line segment represented by the piece of the connecting line segment data, the section of the target stitch being a section in which at least one specific intersecting stitch is distributed, each of the at least one specific intersecting stitch being a stitch intersecting the target stitch, being later in sewing order than the target stitch, and corresponding to one of the divided areas to which the at least one area thread color including the embroidery thread color of the target stitch is allocated.

8. A non-transitory computer-readable medium storing an embroidery data generating program, the program comprising instructions that cause a controller to perform the steps of:

acquiring, as a plurality of available thread colors, colors of threads to be used in sewing an embroidery pattern;

generating line segment data, each piece of the line segment data representing a position of a line segment that corresponds to a target pixel, the target pixel being at least one of pixels represented by pixel data included in image data;

dividing, based on the pixel data, a whole area of an image represented by the image data into a plurality of divided areas;

determining, based on the pixel data corresponding to pixels within each of the divided areas, a representative color for each of the divided areas;

comparing the representative color for each of the divided areas with the available thread colors, and allocating to each of the divided areas at least one of the available thread colors that satisfies a predetermined condition, as at least one area thread color;

generating, based on a position, in the image, of the target pixel corresponding to each piece of the line segment data, an associated relationship between each piece of the line segment data and one of the divided areas;

allocating, based on the associated relationship and an allocation result of the at least one area thread color, to each piece of the line segment data one of the at least one area thread color that represents the color of the target pixel corresponding to each of the line segment data, as an embroidery thread color;

generating, when a same thread color is allocated as the embroidery thread color to plural pieces of the line segment data, connecting line segment data, each piece of the connecting line segment data representing a connecting line segment to connect two line segments respectively represented by two of plural pieces of line segment data; and generating embroidery data that includes a sewing order, thread color data and needle drop point data, based on the line segment data, the embroidery thread color allocated to each piece of the line segment data and the connecting line segment data.

9. The computer-readable medium according to claim 8, wherein at least one of the available thread colors that satisfies a first condition is allocated to each of the divided areas, as the at least one area thread color, the first condition being a condition under which a color difference between the at least one of the available thread colors and the representative color is smaller than a first threshold value.

10. The computer-readable medium according to claim 9, wherein when a number of the at least one area thread color allocated to any one of the divided areas in accordance with the first condition is smaller than a predetermined number, from among the available thread colors that have not been allocated as the at least one area thread color, at least one of the available thread colors that satisfies a second condition is allocated to the any one of the divided areas, as the at least one area thread color, the second condition being a condition under which a color difference between the at least one of the available thread colors and the representative color of the any one of the divided areas is a minimum.

11. The computer-readable medium according to claim 9, wherein when a color difference between the at least one area thread color allocated to any one of the divided areas in accordance with the first condition and the representative color is larger than a second threshold value, in addition to the at least one area thread color already allocated to the any one of the divided areas, from among the available thread colors that have not been allocated as the at least one area thread color, at least one of the available thread colors that satisfies a second condition is allocated to the any one of the divided areas, as the at least one area thread color, the second condition being a condition under which a color difference between the at least one of the available thread colors and the representative color of the any one of the divided areas is a minimum.

12. The computer-readable medium according to claim 8, wherein when the at least one area thread color is already allocated to any one the divided areas, based on the at least one area thread color allocated to the any one of the divided areas and on the representative color, at least one of the available thread colors that satisfies a first condition is allocated to the any one of the divided areas, as the at least one area thread color, the first condition being a condition under which the at least one of the available thread colors is selected from among the available thread colors that have not yet been allocated as the at least one area thread color.

13. The computer-readable medium according to claim 8, wherein at least a predetermined number of the available thread colors is allocated to each of the divided areas as the at least one area thread color, the predetermined number corresponding to a characteristic amount calculated based on color differences between the representative color of each of the divided areas and colors of pixels included in each of the divided areas.

14. The computer-readable medium according to claim 8, wherein the step of generating the embroidery data includes the step of:

generating, as needle drop point data corresponding to a piece of the connecting line segment data, data that causes a running stitch to be sewn on the connecting line segment represented by the piece of the connecting line segment data, when the piece of the connecting line segment data satisfies a first condition, and that generates, as the needle drop point data corresponding to the piece of the connecting line segment data, data that causes a jump stitch to be sewn on the connecting line segment represented by the piece of the connecting line segment data, when the piece of the connecting line segment data does not satisfy the first condition, the first condition being a condition under which a length of a section of a target stitch satisfies a predetermined condition, the target stitch being a stitch to be formed on the connecting line segment represented by the piece of the connecting line segment data, the section of the target stitch being a section in which at least one specific intersecting stitch is distributed, each of the at least one specific intersecting stitch being a stitch intersecting the target stitch, being later in sewing order than the target stitch, and corresponding to one of the divided areas to which the at least one area thread color including the embroidery thread color of the target stitch is allocated.

* * * * *